United States Patent [19]

Tokoli et al.

[11] Patent Number: 4,665,000

[45] Date of Patent: May 12, 1987

[54] PHOTORESPONSIVE DEVICES CONTAINING AROMATIC ETHER HOLE TRANSPORT LAYERS

[75] Inventors: Emery G. Tokoli, Rochester; Anthony M. Horgan, Pittsford, both of N.Y.

[73] Assignee: Xerox Corporation, Stamford, Conn.

[21] Appl. No.: 662,926

[22] Filed: Oct. 19, 1984

[51] Int. Cl.[4] ..... G03G 5/06

[52] U.S. Cl. ..... 430/85; 430/58; 430/59; 430/64; 430/73; 430/80; 564/428; 564/429; 564/430; 564/444

[58] Field of Search ..... 430/58, 59, 73, 80, 430/85, 64; 564/428, 429, 430; 548/444

[56] References Cited

U.S. PATENT DOCUMENTS

| | | | |
|---|---|---|---|
| 4,072,520 | 2/1978 | Rochlitz et al. | 96/1.5 R |
| 4,247,614 | 1/1981 | Ohta et al. | 430/79 |
| 4,265,990 | 5/1981 | Stolica et al. | 430/96 |
| 4,293,630 | 10/1981 | Oka | 430/59 |
| 4,330,608 | 5/1982 | Limburg et al. | 430/59 |
| 4,410,616 | 10/1983 | Griffiths et al. | 430/59 |
| 4,415,639 | 11/1983 | Horgan | 430/58 |
| 4,457,994 | 7/1984 | Pai et al. | 430/59 |
| 4,467,023 | 8/1984 | Chu et al. | 430/59 |
| 4,471,039 | 9/1984 | Borsenbeger et al. | 430/59 |
| 4,477,550 | 10/1984 | Horie et al. | 430/59 |

*Primary Examiner*—John E. Kittle
*Assistant Examiner*—Mukund J. Shah
*Attorney, Agent, or Firm*—E. O. Palazzo

[57] ABSTRACT

Disclosed for incorporation in imaging members are novel aromatic ether compositions of the formula R—X—$R_1$, wherein R and $R_1$ are independently selected from arylamino and substituted arylamino groups, and X is selected from the group consisting of oxygen, sulfur, selenium, and tellurium. Also disclosed are photoresponsive imaging devices containing a photogenerating layer and in contact therewith a hole transport layer comprised of the aromatic ethers illustrated herein.

35 Claims, 3 Drawing Figures

PHOTORESPONSIVE DEVICES CONTAINING AROMATIC ETHER HOLE TRANSPORT LAYERS

BACKGROUND OF THE INVENTION

This invention is generally directed to photoresponsive imaging members or devices, and more specifically, the present invention is directed to an improved layered photoresponsive device with hole transport layers comprised of certain novel compositions of matter possessing an aromatic ether linkage, including sulfur and oxygen ethers, which compositions have improved solubility and desirable compatibility with the polymeric binder resinous substances within which they are dispersed. Accordingly, in one embodiment of the present invention there are provided improved overcoated photoresponsive imaging members comprised of a photogenerating layer, and in contact therewith a hole transport layer containing therein the novel aromatic ether compositions illustrated herein. There is further provided in accordance with the present invention overcoated photoresponsive devices containing a hole transport layer comprised of the aromatic ether compositions described, situated between a photogenerating layer and a supporting substrate, and also there are provided layered overcoated photoresponsive devices sensitive to visible light and infrared radiation comprised of a photogenerating layer, a photoconductive layer, and a hole transport layer containing the aromatic ether compositions of the present invention. The photoresponsive imaging devices of the present invention are useful in various electrostatographic imaging systems, including xerographic imaging systems, and xerographic printing systems, wherein high quality images are obtained.

Electrostatographic imaging processes, which are well known, involve the formation and development of electrostatic latent images on the surface of photoconductive materials referred to in the art as photoreceptors or photosensitive compositions. In these imaging systems, and in particular in xerography, the xerographic plate containing the photoconductive insulating layer is imaged by uniformly electrostatically charging its surface, followed by exposure to a pattern of activating electromagnetic radiation such as light, thereby selectively dissipating the charge in the illuminated areas of the photoconductive member causing a latent electrostatic image to be formed in the non-illuminated areas. This latent electrostatic image can then be developed with compositions containing toner particles and carrier particles, followed by subsequently transferring this image to a suitable substrate such as paper. Many known photoconductive members can be selected for incorporation into the electrostatographic imaging system including, for example photoconductive insulating materials deposited on conductive substrates, as well as those containing a thin barrier layer film of aluminum oxide situated between the substrate and the photoconductive composition. The barrier layer is primarily for the purpose of preventing charge injection from the substrate into the photoconductive layer subsequent to charging, as injection could adversely affect the electrical properties of the photoreceptor compositions involved.

Examples of photoconductive members include those comprised of inorganic materials and organic materials, composite layered devices containing inorganic or organic substance, layered devices containing photoconductive substances dispersed in other materials, and the like. An example of one type of composite photoconductive layer used in xerography is described, for example in U.S. Pat. No. 3,121,006, wherein there is disclosed finely divided particles of a photoconductive inorganic compound dispersed in an electrically insulating organic resin binder. In a commercial form, the photoconductive composition involved is comprised of a paper backing containing a coating thereon of a binder layer comprised of particles of zinc oxide uniformly dispersed therein. Useful binder materials disclosed include those which are incapable of transporting for any significant distance injected charge carriers generated by the photoconductive particles. Accordingly, as a result, the photoconductive particles must be in substantially contiguous particle to particle contact throughout the layer for the purpose of permitting charge dissipation required for a cyclic operation. Thus, about 50 percent by volume of photoconductive particles is usually necessary in order to obtain sufficient photoconductor particle to particle contact for rapid discharge. These high photoconductive concentrations can destroy the physical continuity of the resin particles, thus significantly reducing the mechanical strength of the binder layer.

Illustrative examples of specific binder materials disclosed in the '006 patent include, for example polystyrene resins, silicone resins, acrylic and methacrylic ester polymers, polymerized ester derivatives of acrylic and alpha-acrylic acids, chlorinated rubber, vinyl polymers and copolymers, and cellulose esters.

Other known photoresponsive compositions include amorphous selenium, halogen doped amorphous selenium substances, amorphous selenium alloys, including selenium arsenic, selenium tellurium, selenium arsenic antimony, halogen doped selenium alloys wherein the halogen is a material such as chlorine, iodine or fluorine, cadmium sulfide and the like. Generally, these photoconductive materials are deposited on suitable conductive substrates and incorporated into xerographic imaging systems for use as imaging members.

Recently there has been disclosed layered photoresponsive devices comprised of photogenerating layers and transport layers, deposited on conductive substrates as described, for example, in U.S. Pat. Nos. 4,265,990; 4,233,383; 4,281,054 and 4,415,639; and overcoated photoresponsive materials with a hole injecting layer, a hole transport layer, a photogenerating layer and a top coating of an insulating organic resin, as described, for example in U.S. Pat. No. 4,251,612. Examples of generating layers disclosed in these patents include trigonal selenium and various phthalocyanines, while examples of hole transport layers include certain diamines dispersed in inactive polycarbonate resin materials. The disclosures of each of these patents are totally incorporated herein by reference.

Additionally, there is disclosed in Belgium Pat. No. 763,540 an electrophotographic member having at least two electrically operative layers, the first layer comprising a photoconductive layer which is capable of photogenerating charge carriers, and injecting the photogenerated holes into a continuous second active layer containing a transport organic material. The organic material is substantially non-absorbing in the spectral region of intended use, however, it is active in that it allows the injection of photogenerated holes from the photoconductive layer and allows these holes to be transported through the active layer.

Other representative patents disclosing layered photoresponsive devices include U.S. Pat. Nos. 3,041,116; 4,115,116; 4,047,949 and 4,081,274.

Several of the above-described layered photoresponsive devices possess undesirable characteristics, for example, in these devices there is limited solubility of the hole transport material in the resinous binders which adversely effects photosensitivity. Additionally, some of the hole transport layer glass transition temperatures are near, or below room temperature thus constraining these devices mechanically, and limiting their use.

While the above described photoresponsive devices are suitable for their intended purposes, there continues to be a need for improved devices. Additionally, there continues to be a need for improved transport materials, especially those transport materials of improved solubility in the resinous binder, which solubility is believed caused by the presence of an ether linkage. Further, these materials possess excellent hole transport properties in view of the presence of aromatic tertiary amine groups. Also, there continues to be a need for improved overcoated photoresponsive devices containing a photogenerating layer, and a charge transport layer comprised of novel aromatic compositions containing an ether linkage, or ether linkages, which compositions have improved solubility in resinous binders within which they are present, and excellent hole transporting properties. Improved solubility enables loading of the hole transport molecule at 90 percent by weight in the resinous binder, without adverse crystallization occurring. Furthermore, the glass transition temperature of the aromatic ether compositions are above room temperature enabling the resulting devices to maintain desirable mechanical properties.

Furthermore, there continues to be a need for improved photoresponsive devices containing easily prepared novel hole transport molecules. Also, there continues to be a need for improved photoresponsive imaging members containing improved transport materials, and wherein these members are responsive in the visible and/or infrared region of the spectrum. Moreover, there continues to be a need for improved photoresponsive devices with a hole transport layer comprised of aromatic ether compositions situated between a photogenerating layer and a supporting substrate; and for photoresponsive devices with sensitive layers comprised of inorganic photogenerating compositions, and organic photoconductive compositions situated between a hole transport layer, and a supporting substrate.

SUMMARY OF THE INVENTION

It is an object of the present invention to provide photoresponsive devices with improved hole transport molecules which overcome the abovenoted disadvantages.

It is yet another object of the present invention to provide novel aromatic ether hole transporting molecules.

It is yet another object of the present invention to provide layered photoresponsive imaging members comprised of a photogenerating layer, and in contact therewith a hole transport layer containing aromatic ether compositions.

In a further object of the present invention there is provided improved photoresponsive imaging members useful in electrostatographic imaging systems, particularly xerographic imaging devices, and containing a photogenerating layer, and as a hole transporting layer, an aromatic ether charge. In yet a further object of the present invention there is provided layered photoresponsive devices with an aromatic ether charge transport layer situated between a photogenerating layer and a supporting substrate.

In still a further object of the present invention there are provided layered photoresponsive devices containing a supporting substrate, a photoconductive composition, a photogenerating layer composition, and an aromatic ether charge transport layer.

These and other objects of the present invention are accomplished by providing an improved photoresponsive device comprised of a photogenerating layer, and an aromatic ether charge transport layer. More specifically, the present invention in one embodiment is directed to an improved layered photoresponsive device comprised of (1) a supporting substrate, (2) a photogenerating layer comprised of a photogenerating composition optionally dispersed in a resinous binder, and (3) a charge transport layer comprised of an inert resinous binder composition, having dispersed therein an aromatic ether composition of the formula R—X—$R_1$, wherein R and $R_1$ are independently selected from arylamino, including diarylamino and substituted arylamino groups, such as arylalkylamino, and X is selected from the group consisting of oxygen, sulfur, selenium and tellurium. These aromatic ether compositions may contain more than one X group, thus there may be incorporated into the ether compositions from about 1 to about 5 oxygen atoms, sulfur atoms, selenium atoms, tellurium atoms, or mixtures thereof. Accordingly, examples of other aromatic ether compositions useful as a charge transport molecule for incorporation into the photoresponsive imaging member of the present invention include those of the formulas R—X—$R_1$—X—R, R—X—$R_1$—X—R—X—$R_1$ and the like.

Illustrative examples of aryl groups include those containing from about 6 to about 24 carbon atoms, such as phenyl, naphthyl, anthryl, with phenyl and naphthyl being preferred. The aryl groups may be substituted with various substituents, providing they do not adversely affect the charge transporting properties thereof, which substituents include alkyl, halogen, nitro, sulfonyl, carboxyl, carbonyl, nitroso, and the like.

Illustrative examples of alkyl substituents include those containing from 1 carbon atom to about 25 carbon atoms, such as methyl, ethyl, propyl, butyl, pentyl, hexyl, nonyl, pentadecyl, eicosyl, and the like, with alkyl groups of from 1 to about 10 carbon atoms being preferred. Representative alkylaryl groups include, for example,

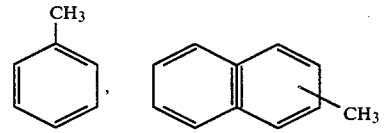

and the like.

Examples of the aromatic ethers of the present invention include bis-triphenylamine ether I, bis-[N-diphenyl]-naphthylamine ether, More specifically, examples of aromatic ether compositions of the present invention are represented by the following formulas:

I.

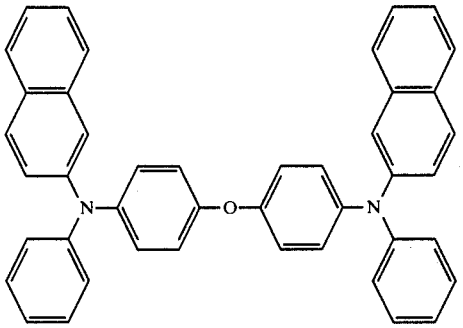

bis[N—2-naphthyl]diphenylamine ether.

II.

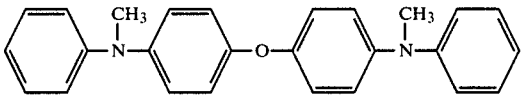

bis[N—methyl]-diphenylamine ether.

III.

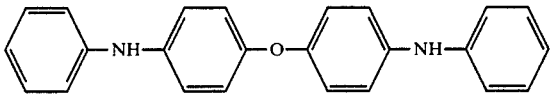

bis(diphenyl amine) ethers.

IV.

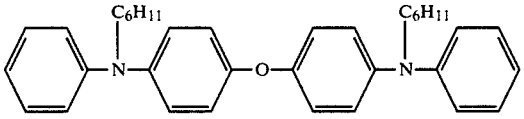

bis[N—2 cyclohexyl]diphenylamine ethers.

V.

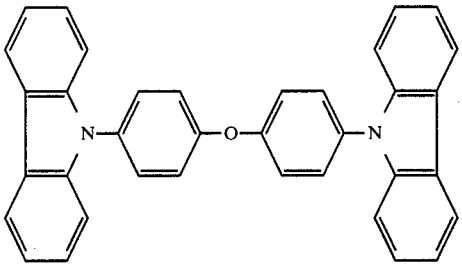

bis(N—phenyl carbazole)ether.

VI.

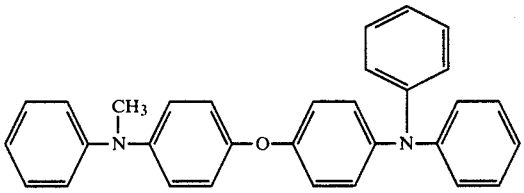

[N—methyl-N—phenyl], [N'—diphenyl]-4,4'-oxydianiline.

VII.

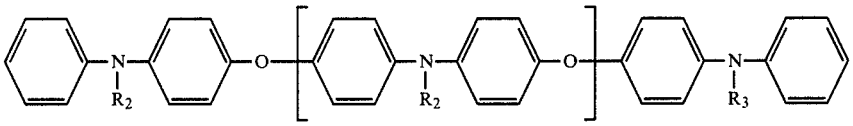

$R_2$ and $R_3$ are hydrogen, alkyl, cycloalkyl aryl, alkylaryl groups substituted or unsubstituted, and n is a number of from 1 to 5,000.

The aromatic ethers of the present invention are generally prepared by the reaction of an aromatic amine with a halogen compound. More specifically, these ethers are prepared by the Ullman reaction, wherein for example equal molar quantities of an aromatic amine are reacted with a halogen compound in the presence of a copper containing catalyst and at a temperature of from about 100° C. to about 250° C. for a period of from about 2 hours to about 24 hours. This general method is suitable for the preparation of amines with hole transport capabilities.

BRIEF DESCRIPTION OF THE DRAWINGS

For a better understanding of the present invention and further features thereof, reference is made to the following detailed description of various preferred embodiments wherein.

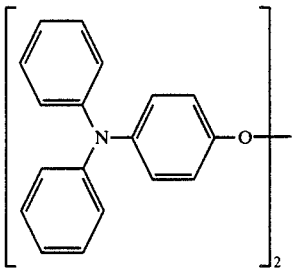

II

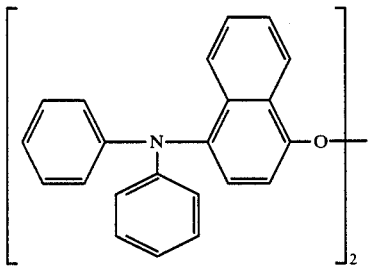

bis[N-2-naphthyl]diphenylamine ether, bis[N-methyl]-diphenylamine ether and the like.

Figure 3:
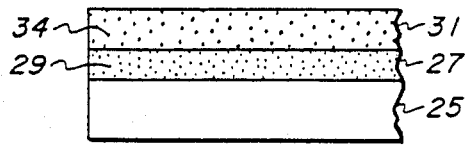

FIG. 3 is a partially schematic, cross-sectional view illustrating another photoresponsive imaging member of the present invention.

DESCRIPTION OF THE PREFERRED EMBODIMENTS

Figure 1:
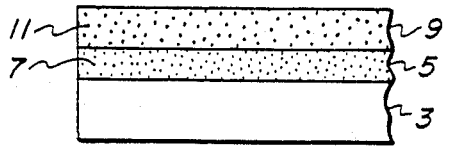
FIG. 1 is a partially schematic, cross-sectional view of the photoresponsive device of the present invention.

Illustrated in FIG. 1 is a layered photoresponsive imaging member of the present invention, comprising an optional supporting substrate 3, preferably a Metallized insulating substrate, a charge carrier photogenerating layer 5, with a photogenerating composition, optionally dispersed in a resinous binder 7, and a layer of charge carrier transport material 9, containing as a charge transporting substance, the aromatic ether compositions of the present invention dispersed in an inert resinous binder 11.

Figure 2:
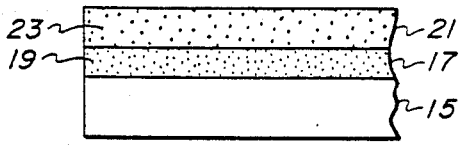
FIG. 2 is a partially schematic, cross-sectional view illustrating a photoresponsive imaging member of the present invention.

Illustrated in FIG. 2 is a preferred photoresponsive device of the present invention wherein the substrate 15 is comprised of Metallized Mylar, in a thickness of 3 mils, the photogenerating layer 17, thickness of 2 microns, is comprised of 7.5 percent by volume of vanadyl phthalocyanine or trigonal selenium, dispersed in a resinous polyester or polyvinylcarbazole binder and the hole transport layer 21, with a thickness of about 25 microns, is comprised of bis-triphenylamine ether, 60 percent by weight, dispersed in 40 percent by weight of a polycarbonate resinous binder 23, commercially available as Makrolon.

Illustrated in FIG. 3 is another photoresponsive imaging device of the present invention, comprised of a substrate 25 comprised of Metallized Mylar, in a thickness of 4 mils, a photogenerating layer 27, containing vanadyl phthalocyanine or trigonal selenium, 30 percent by volume, dispersed in the resinous binder polyester or polyvinylcarbazole, which resinous binder is present in an amount of 70 volume percent, this layer having a thickness of 0.5 micron, and a charge hole transport layer 31 containing 60 percent by weight of bistetranitro benzophenone ether, dispersed in 40 percent by weight of a polycarbonate resinous binder 34 with a thickness of about 25 microns.

The substrates selected may be opaque or substantially transparent and may comprise numerous suitable supporting materials with the required mechanical properties. Accordingly, the substrate may comprise a layer of insulating material, such as an inorganic or an organic polymeric composition, on which is deposited a conductive material such as Aluminum, Nickel, or Chromium, or the substrate can be a conductive material such as aluminum, nickel, or chromium. The conductive material in one embodiment of the present invention may be deposited on a flexible substrate. Illustrative insulating compositions include various materials known for this purpose, including resins such as polyesters, polycarbonates, polyamides, polyurethanes, terephthalic resins, commercially available as Mylar, and the like.

The supporting substrate may be flexible or rigid and may be of any number of different configurations including, for example, a plate, a cylindrical drum, scrolls, and endless flexible belt, and the like. Preferably, the substrate is in the form of an endless flexible belt and is comprised of a material commercially available as Metallized Mylar.

The thickness of the supporting substrate layer depends on numerous factors, including economical considerations. Thus this layer may be of substantial thickness, for example, over 200 microns, or of minimum thickness, less than 50 microns, provided there are no adverse effects on the device. In one embodiment, the thickness of this layer is from about 65 microns to about 150 microns, and preferably from about 75 microns to about 125 microns. Also, the substrate may have deposited thereon an anticurl coating, a silane layer, or an adhesive composition, inclusive of polyesters, vinyl butyral, polycarbonates, and other similar substances.

The photogenerating layer 5 is comprised of a photogenerating material comprised of substances well known in the art, including inorganic or organic photogenerating compositions. Illustrative examples of inorganic materials include those well known in the art such as amorphous selenium, selenium alloys, including selenium tellurium, selenium-tellurium-arsenic, selenium arsenic, cadmium sulfoselenide, cadmium selenide, cadmium sulfide, and other forms of selenium and selenium alloys, such as the crystalline form of selenium known commonly as trigonal selenium. Also, there can be selected as the photogenerating substance doped selenium substances, and doped selenium alloys, wherein the dopant contains various known materials including halogens and alkali metals. Examples of specific dopants selected are chlorine, bromine, iodine and sodium, which dopants are present in an amount ranging from about 50 parts per million to about 5,000 parts per million and preferably from about 100 to 300 parts per million. In addition to trigonal selenium, one preferred inorganic photoconductive composition useful in the photogenerating layer 5 is a halogen doped selenium arsenic alloy, wherein the percentage by weight of selenium is from about 95 to about 99.5 percent, the percentage of arsenic ranges from about 5 percent to about 0.5 percent, and the halogen chlorine is present in an amount of from about 100 parts per million to about 1,000 parts per million.

Illustrative examples of organic materials selected as the photogenerating pigment include various known materials such as metal free phthalocyanines, metal phthalocyanines, vanadyl phthalocyanines, squarylium pigments, intermolecular charge transfer complexes including poly(N-vinylcarbazole) and trinitrofluorenone, and the like, as well as the additional photogenerating pigments as described in U.S. Pat. Nos. 4,265,990; 4,233,383; 4,281,054; 4,415,639 and 4,251,612, the disclosure of each of these patents being totally incorporated herein by reference. Other specific examples of photogenerating pigments include the X-form of metal free phthalocyanine, reference U.S. Pat. No. 3,357,989 the disclosure of which is totally incorporated herein by reference, metal phthalocyanines such as copper phthalocyanine; quinacridones commercially available from duPont Chemical Corporation under the tradenames Monastral Red, Monastral Violet and Monastral Red Y; substituted 2,4-diamino-triazines, reference U.S. Pat. No. 3,442,781; and polynuclear aromatic quinones available from Allied Chemical Corporation under the tradename Indofast Double Scarlet, Indofast Violet Lake B, Indofast Briiliant Scarlet and Indofast Orange. Also useful as the photogenerating pigment are various squarylium pigments and dyes.

The preferred organic photoconductive composition for the photogenerating layer is vanadyl phthalocyanine.

The photogenerating layer may be comprised of 100 percent of the inorganic or organic compositions, or these compositions can be dispersed in various resinous polymeric binder materials, in amounts of from about 5 percent by volume to about 95 percent by volume, and preferably in amounts of from about 25 percent by volume to about 75 percent by volume. Illustrative examples of polymeric binder resinous materials that can be selected include those as disclosed, for example, in U.S. Pat. No. 3,121,006 the disclosure of which is totally incorporated herein by reference, polyesters, polyvinylbutyral, Formvar®, polycarbonate resins, polyvinylcarbazole, epoxy resins, and phenoxy resins, especially the commercially available poly(hydroxyether) resins, as described in copending application U.S. Ser. No. 420,961, filed 9/21/82, the disclosure of which is totally incorporated herein by reference.

Generally, the thickness of the photogenerating layer 5 depends on a number of factors, including the thicknesses of the other layers, and the percent mixture of photoconductive material contained in this layer. Accordingly, this layer can be of a thickness of from about 0.5 microns to about 10 microns when the photogenerating pigment such as vanadyl phthalocyanine is present in an amount of from about 5 percent by volume to about 100 percent by volume, and preferably this layer is of a thickness of from about 0.25 microns to about 1 micron, when the photogenerating composition, such as vanadyl phthalocyanine, is present in an amount of from about 30 percent by volume. The maximum thickness of this layer is dependent primarily upon factors such as mechanical considerations, for example, whether a flexible photoresponsive device is desired, and the like, generally however, this layer has a maximum thickness of up to about 25 microns.

The hole transport layer 9 is comprised of the aromatic ether compositions as disclosed herein, which compositions are dispersed in inactive resinous binders. Examples of resinous binder materials 11 include substances as described in U.S. Pat. No. 3,121,006, the disclosure of which is totally incorporated by reference. Specific examples of organic resinous materials include polycarbonates, acrylate polymers, vinyl polymers, cellulose polymers, polyesters, polysiloxanes, polyamides, polyurethanes and epoxies as well as block, random or alternating copolymers thereof. Preferred electrically inactive binder materials are polycarbonate resins having a molecular weight ($M_w$) of from about 20,000 to about 100,000 with a molecular weight in the range of from about 50,000 to about 100,000 being particularly preferred. Generally, the resinous binder contains from about 10 to about 95 percent by weight of the aromatic ether and preferably from about 40 percent to about 70 percent of this material.

Generally, the resinous binder 11 is present in the hole transport layer, in an amount of from 5 percent by weight to about 90 percent by weight, and preferably in an amount of from about 30 percent by weight to about 60 percent by weight.

The hole transport layer can be of different thicknesses depending upon the thicknesses of the other layers, providing that this layer allows the transportation or movement of holes. Generally, this layer has a thickness of from about 5 microns to about 50 microns and preferably is of a thickness of from about 20 microns to about 40 microns.

The photoresponsive imaging devices of the present invention can be incorporated into numerous electrostatographic imaging systems, particularly those systems wherein xerographic latent images are formed thereon. The image formed can then be made visible by contact with a developer composition comprised of toner particles and carrier particles. Subsequently, the developed image can be transferred to a suitable substrate such as paper, and optionally permanently affixing the image thereto, utilizing, for example heat.

When the imaging device of the present invention is to be reused to make additional reproductions in a recyclable xerographic apparatus, any residual charge remaining on the photoreceptor after the visible image has been transferred to a receiver member is removed therefrom prior to each repetition of the cycle as is any residual toner material remaining after the transfer step. Generally, the residual charge can be removed from the photoreceptor by ionizing the air about the electrically insulating overcoating of the photoreceptor while the photoconductive carrier generating layer is uniformly illuminated and grounded. For example, charge removal can be effected by AC corona discharge in the presence of illumination from a light source.

The photoresponsive imaging devices of the present invention can be prepared by various known methods, as described for example in U.S. Pat. No. 4,265,990, the disclosure of which has been totally incorporated herein by reference. In one illustrative preparation sequence, for example the photogenerating pigment, such as trigonal selenium, and the resinous binder material such as the poly(hydroxyether), are mixed in a solvent of methylethyl ketone and cellosolve acetate for the purpose of obtaining small particle sizes of trigonal selenium, ranging from about 0.1 to about 5 microns. Mixing is accomplished until the desired particle size trigonal selenium is obtained, approximately 1 to 3 days, and subsequently, the resulting trigonal selenium dispersion is coated with a Bird applicator on a conductive layer, which coating is dried at about 130° C. for about 5 minutes. The transport layer can then be applied by known means, such as solution coating on the photogenerating layer, followed by drying at 135° C. for about 5 minutes. When an additional dielectric layer is incorporated into the photoresponsive device of the present invention, this layer can be vapor deposited on the conducting layer in accordance with known methods.

As indicated herein, the photoresponsive imaging members of the present invention can contain in addition to the layers specified a photoconductive layer comprised, for example of organic photoconductive compositions such as vanadyl phthalocyanine. In this embodiment, therefore, the imaging member contains a photogenerating layer of inorganic substances such as selenium, selenium alloys, or trigonal selenium, and as a photoconductive layer vanadyl phthalocyanine or known squarylium substances. These devices are very useful in printing systems in that they are sensitive to wavelengths in the near infrared region of the spectrum, above about 750 nanometers.

The invention will now be described in detail with respect to specific preferred embodiments thereof, it being understood that these examples are intended to be illustrative only and the invention is not intended to be limited to the materials, conditions and process parameters recited herein. All parts and percentages are by weight unless otherwise indicated. Moreover, in the working examples that follow NOPA is the aromatic ether charge transport material bis[N-2-naphthyl]diphenylamine ether.

EXAMPLE I

A photoreceptive imaging member was prepared by providing an aluminized Mylar substrate in a thickness of 3 mils, and applying thereto wet thickness 0.5 mils, a layer of 0.5 weight percent duPont 49,000 adhesive, a polyester available from E. I. duPont, in methylene chloride and 1,1,2-trichloroethane (4:1 volume ratio) with a Bird applicator. This layer was allowed to dry for one minute at room temperature and 10 minutes at 100° C. in a force air oven, resulting in a layer having a dry thickness of about 0.05 microns.

There was then overcoated on the adhesive layer 10 volume percent of a photogenerating layer comprised of trigonal selenium prepared as follows:

In a 2 oz. amber bottle there was added 0.8 grams polyvinyl carbazole and 14 milliliters, 1:1 volume ratio, tetrahydrofuran and toluene. There was then added to this solution 0.8 grams of trigonal selenium, and 100 grams of stainless steel shot, ⅛" in diameter. The above mixture was then placed on a ball mill for 72 to 96 hours. Subsequently, 5 grams of the resulting slurry was added to a solution of 0.18 grams of polyvinyl carbazole, and 0.15 grams of the charge transporting substance NOPA, bis[N-2-naphthyl]diphenylamine ether in 6.3 milliliters of tetrahydrofuran-toluene, volume ratio 1:1. This slurry was then placed on a shaker for 10 minutes, and thereafter was coated on the above adhesive interface with a Bird applicator, wet thickness 0.5 mils. This layer was then dried at 135° C. for 6 minutes in a forced air oven, resulting in a dry thickness of 2.0 microns. The resulting layer contained 10 volume percent of trigonal selenium, 25 volume percent of NOPA, and 65 volume percent of polyvinyl carbazole.

The above photogenerator layer was overcoated with a charge transport layer which was prepared as follows:

A transport layer containing 40 percent by weight of Makrolon ®, a polycarbonate resin having a molecular weight ($M_w$) of from about 50,000 to about 100,000, commercially available from Larbensabricken Bayer A.G., was mixed with 60 percent by weight of NOPA. The resulting solution was then mixed with 15 percent by weight of methylene chloride. All of the above components were then placed into an amber bottle and dissolved. The mixture was coated to a dry 25 micron thickness layer on top of the above prepared photogenerator layer using a Bird applicator. During this coating process the humidity was equal to or less than 15 percent. The resulting device containing all of the above layers was annealed at 135° C. in a forced air oven for 6 minutes.

EXAMPLE II

A photoreceptive device was prepared by providing an aluminized Mylar substrate in a thickness of 3 mils, and applying thereto in a wet thickness of 0.5 mils, a layer of 0.5 weight percent of duPont 49,000 adhesive, a polyester available from E. I. duPont, in methylene chloride and 1,1,2-trichloroethane (4:1 volume ratio) with a Bird applicator. This layer was then allowed to dry for one minute at room temperature and 10 minutes at 100° C. in a forced air oven. The resulting layer had a dry thickness of 0.05 microns.

There was then overcoated on the above adhesive layer, a photogenerating layer containing 30 volume percent of a trigonal selenium, 25 volume percent of NOPA, and 45 volume percent of polyvinyl carbazole, prepared as follows:

In a 2 oz. amber bottle there was added 0.8 grams polyvinyl carbazole and 18 milliliters, 1:1 volume ratio, tetrahydrofuran/toluene. Added to this solution was 2.1 grams of trigonal selenium, and 100 grams of stainless steel shot, ⅛" in diameter. The above mixture was then placed on a ball mill for 72 to 96 hours, resulting in a slurry. In a 1 oz. amber bottle was added 0.04 grams of NOPA, and 6.4 milliliters of tetrahydrofuran/toluene. Added to this solution was 2 grams of the ball milled slurry. The resulting mixture was then placed on a shaker for 10 minutes, and the slurry formed was coated on the above 49,000 adhesive layer with a Bird applicator, wet thickness 0.5 mils. This device was then dried at 135° C. for 6 minutes in a forced air oven. The dry thickness of the photogenerating generator layer was 0.5 microns.

The above photogenerator layer was then overcoated with a charge transport layer which was prepared as follows:

A transport layer containing 40 percent by weight of Makrolon ®, a polycarbonate resin having a molecular weight ($M_w$) of from about 50,000 to about 100,000, commercially available from Larbensabricken Bayer A.G., was mixed with 60 percent by weight of NOPA. The resulting solution was then mixed with 15 percent by weight of methylene chloride. All of the above components were then placed into an amber bottle and dissolved. The mixture was then coated to a dry 25 micron thickness layer on top of the photogenerator layer using a Bird applicator. During this coating process the humidity was equal to or less than 15 percent.

The resulting device containing all of the above layers was annealed at 135° C. in a forced air oven for 6 minutes.

EXAMPLE III

A photoreceptive device was prepared by providing an aluminized Mylar substrate in a thickness of 3 mils, and applying thereto in a wet thickness of 0.5 mils, a layer of 0.5 percent by weight of duPont 49,000 adhesive, a polyester available from duPont, in methylene chloride and 1,1,2-trichloroethane (4:1 volume ratio) with a Bird applicator. The wet thickness was 0.5 mil. This layer was then allowed to dry for one minute at room temperature and 10 minutes at 100° C. in a forced air oven. The resulting layer had a dry thickness of about 0.05 microns.

A photogenerator layer containing 33 percent by volume of trigonal selenium, and 13 percent by volume of NOPA dispersed in 54 percent of the phenoxy resinous binder available from Union Carbide as Bakelite PHKK was prepared as follows:

In a 4 oz. amber bottle was added 1.6 grams of the above phenoxy resin, 0.4 grams NOPA, in 21 milliliters of methyl ethyl ketone, and 7 milliliters methoxyethyl acetate (cellosolve acetate). Added to this solution was 3.2 grams of trigonal selenium, and 200 grams of stainless steel shot, ⅛" in diameter. The above mixture was then placed on a ball mill for 72 to 96 hours. The slurry was then coated on the above duPont 49,000 adhesive layer with a Bird applicator, in a wet thickness 0.5 mils. The resulting device was then dried at 135° C. for 6 minutes in a forced air over. The dry thickness of the photogenerating generator layer fro 0.5 microns.

The above photogenerator layer was then overcoated with a charge transport layer which was prepared as follows:

A transport layer containing 40 percent by weight of Makrolon ®, a polycarbonate resin having a molecular weight ($M_w$) of from about 50,000 to about 100,000, commercially available from Larbensabricken Bayer A.G., was mixed with 60 percent by weight of NOPA. The resulting solution was then mixed with 15 percent by weight of methylene chloride. All of the above components were then placed into an amber bottle and dissolved. The mixture was then coated to a dry 25 micron thickness layer on top of the above prepared photogenerating layer using a Bird applicator. During this coating process the humidity was equal to or less than 15 percent.

The resulting device containing all of the above layers was annealed at 135° C. in a forced air oven for 6 minutes.

EXAMPLE IV

A photoreceptive device was prepared by providing an aluminized Mylar substrate in a thickness of 3 mils, and applying thereto a layer of 0.5 percent by weight of duPont 49,000 adhesive, in methylene chloride and 1,1,2-trichloroethane 4:1 volume with a Bird applicator. The layer was allowed to dry for one minute at room temperature, and 10 minutes at 100° C. in a forced air oven. The dry thickness of the resulting layer was 0.05 microns.

A photogenerating layer containing 30 percent by volume of vanadyl phthalocyanine was then prepared as follows:

In a 2 oz. amber bottle was added 0.76 grams of duPont 49,000 polyester in 16 milliliters methylene chloride. Added to this solution was 0.36 grams of vanadyl phthalocyanine, and 100 grams ⅛" stainless steel shot. The above mixture was placed on a ball mill for 24 hours. To 5 grams of this slurry was added 10 milliliters of methylene chloride. This slurry is coated on the above polyester adhesive layer with a Bird applicator, to a wet thickness of 0.5 mils. This layer was allowed to air dry for 5 minutes. This device was dried at 135° C. for 6 minutes in a forced air oven. The dry thickness was 0.5 microns.

The above prepared photogenerating layer was then overcoated with a charge transport layer which was prepared as follows:

A transport layer containing 40 percent by weight of Makrolon ®, a polycarbonate resin having a molecular weight ($M_w$) of from about 50,000 to about 100,000, commercially available from Larbensabricken Bayer A.G., was mixed with 60 percent by weight of NOPA. This solution was then mixed with 15 percent by weight of methylene chloride. All of the above components were then placed into an amber bottle and dissolved. The mixture was coated to a dry 25 micron thickness layer on top of the generator layers using a Bird applicator. During this coating process the humidity was equal to or less than 15 percent.

The resulting device containing all of the above layers was annealed at 135° C. in a forced air oven for 6 minutes.

EXAMPLE V

A photoreceptive device was prepared by providing an aluminized Mylar substrate in a thickness of 3 mils, and applying thereto in a wet thickness of 0.5 mils, a layer of 0.5 percent weight of duPont 49,000 polyester adhesive, in methylene chloride and 1,1,2-trichloroethane (4:1 volume ratio) with a Bird applicator. The layer was allowed to dry for one minute at room temperature, and 10 minutes at 100° C. in a forced air oven. The resulting layer had a dry thickness of 0.05 microns.

A photogenerating layer containing 30 percent by volume of hydroxy squarylium was then prepared as follows:

In a 2 oz. amber bottle was added 0.76 grams Formvar 12/85, commercially available from Monsanto Chemical Company and 16 milliliters of tetrahydrofuran. Added to this solution was 0.36 grams of hydroxy squarylium, and 100 grams ⅛" stainless steel shot. The above mixture was placed on a ball mill for 24 hours. To 5 grams of this slurry was added 10 milliliters of tetrahydrofuran. This slurry was then coated on the above adhesive layer with a Bird applicator, to a wet thickness of 0.5 mils. The resulting layer was allowed to air dry for 5 minutes. This device was dried at 135° C. for 6 minutes in a forced air oven. The dry thickness of this layer was 0.5 microns.

The above layer was overcoated with a charge transport layer which was prepared as follows:

A transport layer containing 40 percent by weight of Makrolon ®, a polycarbonate resin having a molecular weight ($M_w$) of from about 50,000 to about 100,000, commercially available from Larbensabricken Bayer A.G., was mixed with 60 percent by weight of NOPA. This solution was mixed with 15 percent by weight of methylene chloride. All of the above components were then placed into an amber bottle and dissolved. The mixture was then coated to a dry 25 micron thickness layer on top of the generator layers using a Bird applicator. During this coating process the humidity was equal to or less than 15 percent.

The resulting device containing all of the above layers was annealed at 135° C. in a forced air oven for 6 minutes.

EXAMPLE VI

A photoreceptive device was prepared by providing an aluminized Mylar substrate in a thickness of 3 mils and applying thereto in a wet thickness of 0.5 mils, a layer of 0.5 percent by weight of duPont 49,000 adhesive, in methylene chloride and 1,1,2-trichloroethane (4:1 volume ratio) with a Bird applicator. The layer was allowed to dry for one minute at room temperature and 10 minutes at 100° C. in a forced air oven. The resulting layer had a dry thickness of 0.05 microns.

A photogenerator layer containing 10 volume percent of trigonal selenium, 25 percent by volume NOPA nd 65 volume percent of polyvinyl carbazole was then prepared as follows:

In a 2 oz. amber bottle was added 0.8 grams polyvinyl carbazole and 14 milliliters 1:1 by volume tetrahydrofuran/toluene. Added to this solution was 0.8 grams of trigonal selenium and 100 grams of ⅛" stainless steel shot. The above mixture was placed on a ball mill for 72 to 96 hours. Five grams of this slurry was added to a solution of 0.18 grams of polyvinyl carbazole and 0.15 grams NOPA in 6.3 milliliters of tetrahydrofuran/toluene. This mixture was placed on a shaker for 10 minutes. The slurry was then coated on the above adhesive interface with a Bird applicator. The wet thickness was 0.5 mils. This layer was dried at 135° C. for 6 minutes in a forced air oven. The dry thickness was 2.0 microns.

A photoconductive layer containing 30 percent by volume vanadyl phthalocyanine was then prepared as follows:

In a 2 oz. amber bottle was added 0.76 grams of duPont 49,000 in 16 milliliters methylene chloride. Added to this solution was 0.36 grams of vanadyl phthalocyanine and 100 grams ⅛" stainless steel shot. The above mixture was placed on a ball mill for 24 hours. To 5 grams of this slurry was added 10 milliliters of methylene chloride. This slurry was then coated on the above photogenerator layer with a Bird applicator to a wet thickness of 0.5 mil. This layer was allowed to air dry 1 to 5 minutes to a dry thickness of 0.5 microns. The resulting device was dried at 135° C. for 6 minutes in a forced air oven.

Thereafter, the above photoconductive layer was overcoated with a charge transport layer which was prepared as follows:

A transport layer containing 40 percent by weight of Makrolon ®, a polycarbonate resin having a molecular weight ($M_w$) of from about 50,000 to about 100,000, commercially available from Larbensabricken Bayer A.G., was mixed with 60 percent by weight of NOPA. This solution was mixed with 15 percent by weight of methylene chloride. All of the above components were then placed into an amber bottle and dissolved. The mixture was then coated to a dry 25 micron thickness layer on top of the above prepared photoconductive layer with a Bird applicator. During this coating process the humidity was equal to or less than 15 percent.

The resulting device containing all of the above layers was annealed at 135° C. in a forced air oven for 6 minutes.

EXAMPLE VII

A photoreceptive device was prepared by providing an aluminized Mylar substrate in a thickness of 3 mils and applying thereto in a wet thickness of 0.5 mils, a layer of 0.5 percent by weight of duPont 49,000 adhesive, in methylene chloride and 1,1,2-trichloroethane (4:1 volume ratio) with a Bird applicator. The layer was allowed to dry for one minute at room temperature and 10 minutes at 100° C. in a forced air oven.

A photogenerator layer containing 30 percent by volume of trigonal selenium, 25 percent by volume NOPA was then prepared as follows:

In a 2 oz. amber bottle was added 0.8 grams polyvinyl carbazole and 18 milliliters, 1:1 by volume tetrahydrofuran/toluene. Added to this solution was 2.1 grams of trigonal selenium and 100 grams of ⅛" stainless steel shot. The above mixture was placed on a ball mill for 72 to 96 hours. In a 1 oz. amber bottle was added 0.04 grams NOPA, and 6.4 milliliters of tetrahydrofuran/toluene. Added to this solution was 2 grams of the ball milled slurry. The resulting mixture was placed on a shaker for 10 minutes, and the slurry formed was then coated on the above 49,000 adhesive layer with a Bird applicator in a wet thickness 0.5 mils. This layer was dried at 135° C. for 6 minutes.

A photoconductive layer containing 30 percent by volume of vanadyl phthalocyanine was then prepared as follows:

In a 2 oz. amber bottle was added 0.76 grams of duPont 49,000 polyester in 16 milliliters methylene chloride. Added to this solution was 0.36 grams of vanadyl phthalocyanine and 100 grams ⅛" stainless steel shot. The above mixture was placed on a ball mill for 24 hours. To 5 grams of the resulting slurry was added 10 milliliters of methylene chloride. This slurry was then coated on the above prepared photogenerator layer with a Bird applicator to a wet thickness of 0.5 mil. This layer was allowed to air dry for 5 minutes to a dry thickness of 0.5 microns. The resulting layer was dried at 135° C. for 6 minutes in a forced air oven.

The above photoconductive layer was overcoated with a charge transport layer which was prepared as follows:

A transport layer containing 40 percent by weight of Makrolon ®, a polycarbonate resin having a molecular weight ($M_w$) of from about 50,000 to about 100,000, commercially available from Larbensabricken Bayer A.G., was mixed with 60 percent by weight of NOPA. This solution was mixed with 15 percent by weight of methylene chloride. All of these components were then placed into an amber bottle and dissolved. The mixture was coated to a dry 25 micron thickness layer on top of the above prepared photoconductive layer with a Bird applicator. During this coating process the humidity was equal to or less than 15 percent.

The resulting device containing all of the above layers was annealed at 135° C. in a forced air oven for 6 minutes.

EXAMPLE VIII

A photoreceptive device was prepared by providing an aluminized Mylar substrate in a thickness of 3 mils and applying thereto in a wet thickness of 0.5 mils, a layer of 0.5 percent by weight of duPont 49,000 adhesive, in methylene chloride and 1,1,2-trichloroethane (4:1 volume ratio) with a Bird applicator. The layer was allowed to dry for one minute at room temperature and 10 minutes at 100° C. in a forced air oven. The resulting layer had a dry thickness of 0.05 microns.

A photogenerator layer was then prepared containing 33 percent by volume of trigonal selenium, and 13 percent by volume of NOPA dispersed in a phenoxy resinous binder, 54 percent by volume, was prepared as follows:

In a 4 oz. amber bottle was added 1.6 grams of the phenoxy resin Bakelite, available from Union Carbide, and 0.4 grams of NOPA, 21 milliliters of methyl ethyl ketone, and 7 milliliters of methoxy ethyl acetate. Added to this solution was 3.2 grams of trigonal selenium, and 200 grams ⅛" stainless steel shot. The above mixture was placed on a ball mill for 72 to 96 hours. The slurry formed was then coated on the above interface with a Bird applicator, to a wet thickness of 0.5 mil, and the resulting layer was allowed to air dry for 5 minutes to a dry thickness of 0.5 microns. The layer was then dried at 135° C. for 6 minutes in a forced air oven.

A photoconductive layer containing 30 percent by volume of vanadyl phthalocyanine was then prepared as follows:

In a 2 oz. amber bottle was added 0.76 grams of duPont 49,000 polyester adhesive, and 16 mil of methylene chloride. Added to this solution was 0.36 grams of vanadyl phthalocyanine and 100 grams ⅛" stainless steel shot. The above mixture was placed on a ball mill for 24 hours. To 5 grams of this slurry was added 10 milliliters of methylene chloride. This slurry was coated on the above photogenerator layer with a Bird applicator to a wet thickness of 0.5 mils. This layer was allowed to air dry for 5 minutes. The device was dried at 135° C. for 6 minutes in a forced air oven to a dry thickness of 0.5 microns.

The above photoconductive layer was overcoated with a charge transport layer prepared as follows:

A transport layer containing 40 percent by weight Makrolon ®, a polycarbonate resin having a molecular weight ($M_w$) of from about 50,000 to about 100,000 available from Larbensabricken Bayer A.G., was mixed with 60 percent by weight of NOPA. This solution was mixed in 15% percent by weight of methylene chloride. All of these components were placed into an amber bottle and dissolved. The mixture was coated to a dry 25 micron thickness layer on top of the photoconductive layer with a Bird applicator. Humidity was equal to or less than 15 percent.

The resulting device containing all of the above layers was then annealed at 135° C. in a forced air oven for 6 minutes.

EXAMPLE IX

A photoreceptive device was prepared by providing an aluminized Mylar substrate in a thickness of 3 mils and applying thereto a layer of 0.5 percent by weight of duPont 49,000 adhesive, a polyester available from duPont, in methylene chloride and 1,1,2-trichloroethane (4:1 volume ratio) with a Bird applicator to a wet thickness of 0.5 mils. The layer was allowed to dry for one minute at room temperature and 10 minutes at 100° C. in a forced air oven. The resulting layer had a dry thickness of 0.05 microns.

A photogenerator layer containing 10 percent volume trigonal selenium, and 25 percent by volume of NOPA and 65 volume percent of polyvinyl carbazole was then prepared as follows:

In a 2 oz. amber bottle was added 0.8 grams polyvinyl carbazole and 14 milliliters, 1:1 volume ratio, tetrahydrofuran/toluene. There was then added to this solution 0.8 grams of trigonal selenium and 100 grams of stainless steel shot, ⅛" in diameter. The above mixture was then placed on a ball mill for 72 to 96 hours. Subsequently, 5 grams of the resulting slurry were added to a solution of 0.18 grams of polyvinyl carbazole, and 0.15 grams of NOPA, in 6.3 milliliters of tetrahydrofuran/toluene, volume ratio 1:1. This slurry was then placed on a shaker for 10 minutes. The resulting slurry was then coated on the above interface with a Bird applicator, wet thickness 0.5 mils. This layer was then dried at 135° C. for 6 minutes in a forced air oven, resulting in a dry thickness of 1.0 microns.

A photoconductive layer containing 30 percent by volume hydroxy squarylium was then prepared as follows:

In a 2 oz. amber bottle was added 0.76 grams Formar 12/85, commercially available from Monsanto and 16 milliliters tetrahydrofuran. Added to this solution was 0.36 grams of hydroxy squarylium and 100 grams ⅛" stainless steel shot. The above mixture was placed on a ball mill for 24 hours. To 5 grams of this slurry was added 10 milliliters of additional solvent. This slurry was then coated on the above photogenerator layer with a Bird applicator, to a wet thickness of 0.5 mils. The resulting device was dried at 135° C. for 6 minutes in a forced air oven. The dry thickness of the photoconductive layer was 0.5 microns.

The above photoconductive layer was overcoated with a charge transport layer which was then prepared as follows:

A transport layer containing 40 percent by weight Makrolon ®, a polycarbonate resin having a molecular weight ($M_w$) of from about 50,000 to about 100,000 available from Larbensabricken Bayer A.G., was mixed with 60 percent by weight of NOPA. The resulting solution was mixed in 15 percent by weight of methylene chloride. All of these components were placed into an amber bottle and dissolved. The mixture was coated to a dry 25 micron thickness layer on top of the photoconductive layer with a Bird applicator. During this coating process the humidity was equal to or less than 15 percent.

The resulting device containing all of the above layers was annealed at 135° C. in a forced air oven for 6 minutes.

EXAMPLE X

A photoreceptive device was prepared by providing an aluminized Mylar substrate in a thickness of 3 mils, and applying thereto in a wet thickness of 0.5 mils, a layer of 0.5 percent by weight of duPont 49,000 adhesive, a polyester available from duPont, in methylene chloride and 1,1,2-trichloroethane (4:1 volume ratio) with a Bird applicator. The wet thickness was 0.5 mil. This layer was then allowed to dry for one minute at room temperature and 10 minutes at 100° C. in a forced air oven. The resulting layer had a dry thickness of about 0.05 microns.

A photogenerator layer containing 30 percent by volume of trigonal selenium 25 percent by volume of NOPA and 45 volume percent of polyvinyl carbazole was prepared as follows:

In a 2 oz. amber bottle was added 0.8 grams polyvinyl carbazole and 18 milliliters, 1:1 volume ratio, tetrahydrofuran/toluene. There was then added to this solution 2.1 grams of trigonal selenium and 100 grams of stainless steel shot, ⅛" in diameter. The above mixture was then placed on a ball mill for 72 to 96 hours. In a 1 oz. amber bottle was added 0.04 grams NOPA and 6.4 milliliters of tetrahydrofuran/toluene, volume ratio 1:1. Added to this solution was 2 grams of the ball milled slurry. This slurry was then placed on a shaker for 10 minutes. The resulting slurry was then coated on the above 49,000 adhesive layer with a Bird applicator, to a wet thickness of 0.5 mils. This device was then allowed to air dry 1 to 5 minutes to a dry thickness for the photogenerator layer of 0.5 microns. The resulting device was then dried at 135° C. for 6 minutes in a forced air oven.

A photoconductive layer containing 30 percent by volume of hydroxy squarylium was prepared as follows:

In a 2 oz. amber bottle was added 0.76 grams Formvar 12/85, and 16 milliliters tetrahydrofuran. Added to this solution was 0.36 grams of hydroxy squarylium and 100 grams ⅛" stainless steel shot. The above mixture was placed on a ball mill for 24 hours. To 5 grams of this slurry was added 10 milliliters of additional solvent. This slurry was then coated on the above generator layer with a Bird applicator, to a wet thickness of 0.5 mils. The resulting device was dried at 135° C. for 6 minutes in a forced air oven. The dry thickness of the photoconductive layer was 0.5 microns.

The above photoconductive layer was overcoated with a charge transport layer which was then prepared as follows:

A transport layer containing 40 percent by weight Makrolon ®, a polycarbonate resin having a molecular weight ($M_w$) of from about 50,000 to about 100,000 available from Larbensabricken Bayer A.G., was mixed with 60 percent by weight of NOPA. The resulting solution was mixed in 15 percent by weight of methylene chloride. All of these components were then placed into an amber bottle and dissolved. The mixture was coated to a dry 25 micron thickness layer on top of the photoconductive layer using a Bird applicator. During this coating process the humidity was equal to or less than 15 percent.

The resulting device containing all of the above layers was annealed at 135° C. in a forced air oven for 6 minutes.

EXAMPLE XI a photoreceptive device was prepared by providing an aluminized Mylar substrate in a thickness of 3 mils, and applying thereto in a wet thickness of 0.5 mils, a layer of 0.5 percent by weight of duPont 49,000 adhesive, a polyester available from duPont, in methylene chloride and 1,1,2-trichloroethane (4:1 volume ratio) with a Bird applicator. The wet thickness was 0.5 mil. This layer was then allowed to dry for one minute at room temperature and 10 minutes at 100° C. in a forced air oven. The resulting layer had a dry thickness of about 0.05 microns.

A photogenerator layer containing 33 percent by volume of trigonal selenium 13 percent by volume of NOPA in the phenoxy binder Bakelite available from Union Carbide was prepared as follows:

In a 4 oz. amber bottle was added 1.6 grams of the above phenoxy resin and 0.4 grams of NOPA, 21 milliliters methyl ethyl ketone and 7 milliliters methoxy ethyl acetate. Added to this solution was 3.2 grams of trigonal selenium and 200 grams of ⅛" stainless steel shot. The above mixture was then placed on a ball mill for 72 to 96 hours. This slurry was then coated on the above polyester with a Bird applicator, to a wet thickness of 0.5 mils. This device was then allowed to air dry 2 to 5 minutes. The dry thickness was 0.5 microns. The resulting device was then dried at 135° C. for 6 minutes in a forced air oven.

A photoconductive layer containing 30 percent by volume of hydroxy squarylium was prepared as follows:

In a 2 oz. amber bottle was added 0.76 grams Monsanto Formvar 12/85, and 16 milliliters tetrahydrofuran. Added to this solution was 0.36 grams of hydroxy squarylium and 100 grams ⅛" stainless steel shot. The above mixture was placed on a ball mill for 24 hours. To 5 grams of this slurry was added 10 milliliters of additional solvent. This slurry was then coated on the above generator layer with a Bird applicator, to a wet thickness of 0.5 mils. The resulting device was dried at 135° C. for 6 minutes in a forced air oven. The dry thickness of the photoconductive layer was 0.5 microns.

The above photoconductive layer was overcoated with a charge transport layer which was then prepared as follows:

A transport layer containing 40 percent by weight Makrolon ®, a polycarbonate resin having a molecular weight ($M_w$) of from about 50,000 to about 100,000 available from Larbensabricken Bayer A.G., was mixed with 60 percent by weight NOPA. The resulting solution was mixed in 15 percent by weight of methylene chloride. All of these components were then placed into an amber bottle and dissolved. The mixture was coated to a dry 25 micron thickness layer on top of the photoconductive layer with a Bird applicator. During this coating process the humidity was equal to or less than 15 percent.

The resulting device containing all of the above layers was annealed at 135° C. in a forced air oven for 6 minutes.

EXAMPLE XII

A photoreceptive device was prepared by providing an aluminized Mylar substrate in a thickness of 3 mils, and applying thereto in a wet thickness of 0.5 mils, a layer of 0.5 percent by weight of duPont 49,000 adhesive, in methylene chloride and 1,1,2-trichloroethane (4:1 volume ratio) with a Bird applicator. This layer was then allowed to dry for one minute at room temperature and 10 minutes at 100° C. in a forced air oven. The resulting layer had a dry thickness of about 0.05 microns.

There was then overcoated on the above adhesive layer by known vacuum evaporation processes, a layer of arsenic triselenide, 0.5 microns in thickness.

A photoconductive layer containing 30 percent by volume vanadyl phthalocyanine was then prepared as follows:

In a 2 oz. amber bottle was added 0.76 grams of duPont 49,000 polyester in 16 milliliters methylene chloride. Added to this solution was 0.36 grams of vanadyl phthalocyanine, and 100 grams ⅛" stainless steel shot. The above mixture was placed on a ball mill for 24 hours. To 5 grams of this slurry was added 10 milliliters of methylene chloride. This slurry was coated on the above photogenerator layer with a Bird applicator, to a wet thickness of 0.5 mils. The resulting layer was allowed to air dry for 5 minutes. This device was dried at 135° C. for 6 minutes in a forced air oven. The dry thickness of the photoconductive layer was 0.5 microns.

The above photoconductive layer was overcoated with a charge transport layer which was then prepared as follows:

A transport layer containing 40 percent by weight Makrolon ®, a polycarbonate resin having a molecular weight ($M_w$) of from about 50,000 to about 100,000 available from Larbensabricken Bayer A.G., was mixed with 60 percent by weight NOPA. The resulting solution was mixed in 15 percent by weight of methylene chloride. All of these components were then placed into an amber bottle and dissolved. The mixture was coated to a dry 25 micron thickness layer on top of the photoconductive layer with a Bird applicator. During this coating process the humidity was equal to or less than 15 percent.

The resulting device was annealed at 135° C. in a forced air oven for 6 minutes.

EXAMPLE XIII

A photoreceptive device was prepared by providing an aluminized Mylar substrate in a thickness of 3 mils, and applying thereto in a wet thickness of 0.5 mils, a layer of 0.5 percent by weight of duPont 49,000 adhesive, in methylene chloride and 1,1,2-trichloroethane (4:1 volume ratio) with a Bird applicator. This layer was then allowed to dry for one minute at room temperature and 10 minutes at 100° C. in a forced air oven. The resulting layer had a dry thickness of about 0.05 microns.

There was then overcoated on the above adhesive layer 49,000 by known vacuum evaporation processes, a layer of arsenic triselenide, 0.5 microns in thickness.

A photoconductive layer containing 30 percent by volume of hydroxy squarylium was then prepared as follows:

In a 2 oz. amber bottle was added 0.76 grams Formvar 12/85, and 16 milliliters tetrahydrofuran. Added to this solution was 0.36 grams of hydroxy squarylium and 100 grams 150" stainless steel shot. The above mixture was placed on a ball mill for 24 hours. To 5 grams of this slurry was added 10 milliliters of additional tetrahydrofuran. The resulting slurry was then coated on the above generator layer with a Bird applicator, to a wet thickness of 0.5 mils. This device was dried at 135° C. for 6 minutes in a forced air oven. The dry thickness of the photoconductive layer was 0.5 microns.

The above photoconductive layer was overcoated with a charge transport layer which was then prepared as follows:

A transport layer containing 40 percent by weight Makrolon ®, a polycarbonate resin having a molecular weight ($M_w$) of from about 50,000 to about 100,000 available from Larbensabricken Bayer A.G., was mixed with 60 percent by weight NOPA. This solution was mixed in 15 percent by weight of methylene chloride. All of these components were then placed into an amber bottle and dissolved. The mixture was coated to a dry 25 micron thickness layer on top of the photoconductive layer with a Bird applicator. During this coating process the humidity was equal to or less than 15 percent.

The resulting device containing all of the above layers was annealed at 135° C. in a forced air oven for 6 minutes.

EXAMPLE XIV

A photoreceptive device was prepared by providing an aluminized Mylar substrate in a thickness of 3 mils, and applying thereto in a wet thickness of 0.5 mils, a layer of 0.5 percent by weight of duPont 49,000 adhesive, in methylene chloride and 1,1,2-trichloroethane (4:1 volume ratio) with a Bird applicator. This layer was then allowed to dry for one minute at room temperature and 10 minutes at 100° C. in a forced air oven. The resulting layer had a dry thickness of about 0.05 microns.

A photoconductive layer containing 30 percent by volume of vanadyl phthalocyanine was then prepared as follows:

In a 2 oz. amber bottle was added 0.76 grams of duPont 49,000 polyester in 16 milliliters methylene chloride. Added to this solution was 0.36 grams of vanadyl phthalocyanine, and 100 grams ⅛" stainless steel shot. The above mixture was placed on a ball mill for 24 hours. To 5 grams of this slurry was added 10 milliliters of methylene chloride. This slurry was coated on the above polyester with a Bird applicator, to a wet thickness of 0.5 mils. This layer was allowed to air dry for 5 minutes. The resulting device was dried at 135° C. for 6 minutes in a forced air oven. The dry thickness of the photoconductive layer was 0.5 microns.

A photogenerator layer containing 10 volume percent of trigonal selenium, 25 percent by volume NOPA and 65 volume percent of polyvinyl carbazole was then prepared as follows:

In a 2 oz. amber bottle was added 0.8 grams polyvinyl carbazole and 14 milliliters 1:1 by volume tetrahydrofuran/toluene. Added to this solution was 0.8 grams of trigonal selenium and 100 grams of ⅛" stainless steel shot. The above mixture was placed on a ball mill for 72 to 96 hours. Five grams of this slurry was added to a solution of 0.18 grams of polyvinyl carbazole and 0.15 grams NOPA in 6.3 milliliters of tetrahydrofuran/toluene. The resulting solution was placed on a shaker for 10 minutes. The slurry formed was then coated on the above photoconductive layer with a Bird applicator, to a wet thickness of 0.5 mils. The resulting device layer was dried at 135° C. for 6 minutes in a forced air oven. The dry thickness of this layer was 2.0 microns.

The above photogenerating layer was overcoated with a charge transport layer which was then prepared as follows:

A transport layer containing 40 percent by weight Makrolon ®, a polycarbonate resin having a molecular weight ($M_w$) of from about 50,000 to about 100,000 available from Larbensabricken Bayer A.G., was mixed with 60 percent by weight NOPA. This solution was mixed in 15 percent by weight of methylene chloride. All of these components were then placed into an amber bottle and dissolved. The mixture was coated to a dry 25 micron thickness layer on top of the photoconductive layer with a Bird applicator. During this coating process the humidity was equal to or less than 15 percent.

The resulting device containing all of the above layers was annealed at 135° C. in a forced air oven for 6 minutes.

EXAMPLE XV

A photoreceptive device was prepared by providing an aluminized Mylar substrate in a thickness of 3 mils, and applying thereto in a wet thickness of 0.5 mils, a layer of 0.5 percent by weight of duPont 49,000 polyester adhesive, in methylene chloride and 1,1,2-trichloroethane (4:1 volume ratio) with a Bird applicator. This layer was then allowed to dry for one minute at room temperature and 10 minutes at 100° C. in a forced air oven. The resulting layer had a dry thickness of about 0.05 microns.

A photoconductive layer containing 30 percent by volume of vanadyl phthalocyanine was then prepared as follows:

In a 2 oz. amber bottle was added 0.76 grams of duPont 49,000 in 16 milliliters methylene chloride. Added to this solution was 0.36 grams of vanadyl phthalocyanine, and 100 grams ⅛" stainless steel shot. The above mixture was placed on a ball mill for 24 hours. To 5 grams of this slurry was added 10 milliliters of methylene chloride. This slurry was coated on the above adhesive interface with a Bird applicator, to a wet thickness of 0.5 mils. This layer was allowed to air dry for 5 minutes. The resulting device was dried at 135° C. for 6 minutes in a forced air oven. The dry thickness of the photoconductive layer was 0.5 microns.

A photogenerator layer containing 33 percent by volume of trigonal selenium and 13 percent by volume of NOPA in a phenoxy resinous binder 54 percent by volume, was then prepared as follows:

In a 4 oz. amber bottle was added 1.6 grams of the above phenoxy resin and 0.4 grams of NOPA, 21 milliliters methyl ethyl ketone and 7 milliliters methoxy ethyl acetate. Added to this solution was 3.2 grams of trigonal selenium and 200 grams of ⅛" stainless steel shot. The above mixture was then placed on a ball mill for 72 to 96 hours. This slurry was then coated over the above photoconductive layer with a Bird applicator, to a wet thickness of 0.5 mils. The resulting device was allowed to air dry 2 to 5 minutes. The dry thickness was 0.5 microns. The device layer was then dried at 135° C. for 6 minutes in a forced air oven.

The above photogenerating layer was overcoated with a charge transport layer which was then prepared as follows:

A transport layer containing 40 percent by weight Makrolon ®, a polycarbonate resin having a molecular weight ($M_w$) of from about 50,000 to about 100,000 available from Larbensabricken Bayer A.G., was mixed with 60 percent by weight NOPA. This solution was mixed in 15 percent by weight of methylene chloride. All of these components were then placed into an amber bottle and dissolved. The mixture was coated to a dry 25 micron thickness layer over the photogenerator with a Bird applicator. During this coating process the humidity was equal to or less than 15 percent.

The resulting device containing all of the above layers was annealed at 135° C. in a forced air oven for 6 minutes.

EXAMPLE XVI

A photoreceptive device was prepared by providing an aluminized Mylar substrate in a thickness of 3 mils, and applying thereto in a wet thickness of 0.5 mils, a layer of 0.5 percent by weight of duPont 49,000, a polyester adhesive available from duPont, in methylene chloride and 1,1,2-trichloroethane (4:1 volume ratio) with a Bird applicator. The wet thickness was 0.5 mil. This layer was then allowed to dry for one minute at room temperature and 10 minutes at 100° C. in a forced air oven. The resulting layer had a dry thickness of about 0.05 microns.

A photoconductive layer containing 30 percent by volume of hydroxy squarylium was prepared as follows:

In a 2 oz. amber bottle was added 0.76 grams Formvar 12/85, (Monsanto) and 16 milliliters tetrahydrofuran. Added to this solution was 0.36 grams of hydroxy squarylium and 100 grams ⅛" stainless steel shot. The above mixture was placed on a ball mill for 24 hours. To 5 grams of this slurry was added 10 milliliters of additional solvent. This slurry was then coated on the above adhesive interface with a Bird applicator, to a wet thickness of 0.5 mils. The resulting device was dried at 135° C. for 6 minutes in a forced air oven. The dry thickness of the photoconductive layer was 0.5 microns.

A photogenerator layer containing 10 percent by volume of trigonal selenium and 25 percent by volume of NOPA and 65 volume percent of polyvinyl carbazole was prepared as follows:

In a 2 oz. amber bottle was added 0.8 grams polyvinyl carbazole and 14 milliliters, 1:1 volume ratio, tetrahydrofuran/toluene. There was then added to this solution 0.8 grams of trigonal selenium and 100 grams of stainless steel shot, ⅛" in diameter. The above mixture was then placed on a ball mill for 72 to 96 hours. In a 1 oz. amber bottle was added 0.15 grams NOPA, 0.18 grams polyvinylcarbazole, and 6.3 milliliters of tetrahydrofuran/toluene, volume ratio 1:1. Added to this solution was 5 grams of the ball milled slurry. This slurry was then placed on a shaker for 10 minutes. The resulting slurry was then coated on the above photoconductive layer with a Bird applicator, to a wet thickness of 0.5 mils. This device was then dried at 135° C. for 6 minutes in a forced air oven, resulting in a dry thickness for the generator layer of 2.0 microns.

The above prepared photogenerating layer was overcoated with a charge transport layer which was prepared as follows:

A transport layer containing 40 percent by weight Makrolon ®, a polycarbonate resin having a molecular weight ($M_w$) of from about 50,000 to about 100,000 available from Larbensabricken Bayer A.G., was mixed with 60 percent by weight NOPA. This solution was mixed in 15 percent by weight of methylene chloride. All of these components were then placed into an amber bottle and dissolved. The mixture was coated to a dry 25 micron thickness layer over the photogenerator with a Bird applicator. During this coating process the humidity was equal to or less than 15 percent.

The resulting device containing all of the above layers was annealed at 135° C. in a forced air oven for 6 minutes.

EXAMPLE XVII

A photoreceptive device was prepared by providing an aluminized Mylar substrate in a thickness of 3 mils, and applying thereto in a wet thickness of 0.5 mils, a layer of 0.5 percent by weight of duPont 49,000 adhesive, a polyester available from duPont, in methylene chloride and 1,1,2-trichloroethane (4:1volume ratio) with a Bird applicator. The wet thickness was 0.5 mil. This layer was then allowed to dry for one minute at room temperature and 10 minutes at 100° C. in a forced air oven. The resulting layer had a dry thickness of about 0.05 microns.

A photoconductive layer containing 30 percent by volume of hydroxy squarylium was prepared as follows:

In a 2 oz. amber bottle was added 0.76 grams Monsanto Formvar 12/85, (Monsanto) and 16 milliliters tetrahydrofuran. Added to this solution was 0.36 grams of hydroxy squarylium and 100 grams ⅛" stainless steel shot. The above mixture was placed on a ball mill for 24 hours. To 5 grams of this slurry was added 10 milliliters of additional solvent. The slurry formed was then coated on the above adhesive layer with a Bird applicator, to a wet thickness of 0.5 mils. The resulting device was dried at 135° C. for 6 minutes in a forced air oven. The dry thickness of the photoconductive layer was 0.5 microns.

A photogenerating layer containing 33 percent by volume of trigonal selenium and 25 percent by volume of NOPA in a Bakelite phenoxy binder was prepared as follows:

In a 4 oz. amber bottle was added 1.6 grams of the above phenoxy resin and 0.4 grams of NOPA, 21 milliliters methyl ethyl ketone and 7 milliliters methoxy ethyl acetate. Added to this solution was 3.2 grams of trigonal selenium and 200 grams of ⅛" stainless steel shot. The above mixture was then placed on a ball mill for 72 to 96 hours. The resulting slurry was then coated over the above photoconductive layer with a Bird applicator, to a wet thickness of 0.5 mils. The resulting device was allowed to air dry 2 to 5 minutes, followed by drying at 135° C. for 6 minutes in a forced air oven. The dry thickness was 0.5 microns.

The above photogenerating layer was overcoated with a charge transport layer which was then prepared as follows:

A transport layer containing 40 percent by weight Makrolon ®, a polycarbonate resin having a molecular weight ($M_w$) of from about 50,000 to about 100,000 available from Larbensabricken Bayer A.G., was mixed with 60 percent by weight NOPA. This solution was mixed in 15 percent by weight of methylene chloride. All of these components were then placed into an amber bottle and dissolved. The mixture was coated to a dry 25 micro thickness layer over the photogenerating layer with a Bird applicator. During this coating process the humidity was equal to or less than 15 percent.

The resulting device containing all of the above layers was annealed at 135° C. in a forced air oven for 6 minutes.

Numerous other photoresponsive devices were prepared by repeating the procedures of the above examples with the exception that there was selected as the photogenerating layer a selenium tellurium alloy, containing 75 percent by weight of selenium, and 25 percent by weight of tellurium, or an arsenic selenium alloy, containing 99.99 percent by weight of selenium, and 0.1 percent by weight of arsenic.

EXAMPLE XVIII

A photoreceptive device was prepared by providing an aluminized Mylar substrate in a thickness of 3 mils, and applying thereto in a wet thickness of 0.5 mils, a layer of 0.5 percent by weight of duPont 49,000 adhesive, a polyester available from duPont, in methylene chloride and 1,1,2-trichloroethane (4:1 volume ratio) with a Bird applicator. This layer was then allowed to dry for one minute at room temperature and 10 minutes at 100° C. in a forced air oven. The resulting layer had a dry thickness of about 0.05 microns.

There was then coated on the adhesive layer a charge transport layer which was prepared as follows:

A transport layer containing 40 percent by weight Makrolon ®, a polycarbonate resin having a molecular weight ($M_w$) of from about 50,000 to about 100,000 available from Larbensabricken Bayer A.G., was mixed with 60 percent by weight NOPA. This solution was mixed in 15 percent by weight of methylene chloride. All of these components were then placed into an amber bottle and dissolved. The mixture was coated to a dry 25 micron thickness layer over the adhesive layer with a Bird applicator. During this coating process the humidity was equal to or less than 15 percent. The resulting device containing all of the above layers was annealed at 135° C. in a forced air oven for 6 minutes.

There was then overcoated on the transport layer 10 volume percent of a photoregenerating layer comprised of trigonal selenium prepared as follows:

In a 2 oz. amber bottle was added 0.8 grams polyvinyl carbazole and 14 milliliters, 1:1 volume ratio, tetrahydrofuran/toluene. There was then added to this solution 0.8 grams of trigonal selenium and 100 grams of stainless steel shot, ⅛" in diameter. The above mixture was then placed on a ball mill for 72 to 96 hours. Subsequently, 5 grams of the resulting slurry were added to a solution of 0.18 grams of polyvinyl carbazole, and 0.15 grams of NOPA, in 6.3 millimiters of tetrahydrofuran/toluene, volume ratio 1:1. This slurry was then placed on a shaker for 10 minutes. The resulting slurry was then coated on the above transport layer interface with a Bird applicator, to a wet thickness of 0.5 mils. This device was then dried at 135° C. for 6 minutes in a forced air oven, resulting in a dry thickness of 2.0 microns. The resulting layer contained 10 volume percent of trigonal selenium, 25 volume percent of the NOPA, and 66 percent of vinyl carbazole.

EXAMPLE XIX

A photoreceptive device was prepared by providing an aluminized Mylar substrate in a thickness of 3 mils, and applying thereto in a wet thickness of 0.5 mils, a layer of 0.5 percent by weight of duPont 49,000 adhesive, a polyester available from duPont, in methylene chloride and 1,1,2-trichloroethane (4:1 volume ratio) with a Bird applicator. This layer was then allowed to dry for one minute at room temperature and 10 minutes at 100° C. in a forced air oven. The resulting layer had a dry thickness of about 0.05 microns.

The above adhesive layer was then overcoated with a charge transport layer which was prepared as follows:

A transport layer containing 40 percent by weight Makrolon ®, a polycarbonate resin having a molecular weight ($M_w$) of from about 50,000 to about 100,000 available from Larbensabricken Bayer A.G., was mixed with 60 percent by weight NOPA. The resulting was then mixed in 15 percent by weight of methylene chloride. All of these components were then placed into an amber bottle and dissolved. The mixture was coated to a dry 25 micron thickness layer over the adhesive layer with a Bird applicator. During this coating process the humidity was equal to or less than 15 percent. The resulting device containing all of the above layers was annealed at 135° C. in a forced air oven for 6 minutes.

There was then overcoated on the above transport layer in the following manner a photogenerating layer, thickness 0.5 microns, containing 30 volume percent of a trigonal selenium, 25 volume percent NOPA and 45 volume percent of polyvinyl carbazole prepared as follows: The resulting device containing all of the above layers was annealed at 135° C. in a forced air oven for 6 minutes.

In a 2 oz. amber bottle was added 0.8 grams polyvinyl carbazole and 18 milliliters, 1:1 volume ratio, tetrahydrofuran/toluene. Added to this solution was 2.1 grams of trigonal selenium and 100 grams of stainless steel shot, ⅛" in diameter. The above mixture was then placed on a ball mill for 72 to 96 hours resulting in a slurry. In a 1 oz. amber bottle was added 0.04 grams NOPA, and 6.4 milliliters of tetrahydrofuran/toluene. Added to this solution was 2 grams of the ball milled slurry. The resulting mixture was then placed on a shaker for 10 minutes, and the slurry formed was then coated over the above transport layer with a Bird applicator, to a wet thickness of 0.5 mils. This device was then dried at 135° C. for 6 minutes in a forced air oven.

EXAMPLE XX

A photoreceptive device was prepared by providing an aluminized Mylar substrate in a thickness of 3 mils, and applying thereto in a wet thickness of 0.5 mils, a layer of 0.5 percent by weight of duPont 49,000 adhesive, a polyester available from duPont, in methylene chloride and 1,1,2-trichloroethane (4:1 volume ratio) with a Bird applicator. The wet thickness was 0.5 mil. This layer was then allowed to dry for one minute at room temperature and 10 minutes at 100° C. in a forced air oven. The resulting layer had a dry thickness of about 0.05 microns.

The above adhesive layer was then overcoated with a charge transport layer which was prepared as follows:

A transport layer containing 40 percent by weight Makrolon ®, a polycarbonate resin having a molecular weight ($M_w$) of from about 50,000 to about 100,000 available from Larbensabricken Bayer A.G., was mixed with 60 percent by weight NOPA. The resulting solution was then mixed in 15 percent by weight of methylene chloride. All of these components were then placed into an amber bottle and dissolved. The mixture was coated to a dry 25 micron thickness layer over the adhesive layer with a Bird applicator. During this coating process the humidity was equal to or less than 15 percent. The resulting device was then dried in a forced air oven for 6 minutes at 135° C.

A photogenerator layer containing 33 percent by volume of trigonal selenium, and 13 percent by volume of NOPA dispersed in 54 percent of the phenoxy resinous binder available from Union Carbide as Bakelite PHKK was prepared as follows:

In a 4 oz. amber bottle was added 1.6 grams of the above phenoxy resin and 0.4 grams of NOPA, 21 milliliters methyl ethyl ketone and 7 milliliters methoxy ethyl acetate (cellosolve acetate). Added to this solution was 3.2 grams of trigonal selenium and 200 grams of ⅛" stainless steel shot. The above mixture was then placed on a ball mill for 72 to 96 hours. This slurry was then coated over the above transport layer with a Bird applicator, in a wet thickness of 0.5 mils. The device layer was then dried at 135° C. for 6 minutes in a forced air oven. The dry thickness of the photogenerating layer was 0.5 microns.

EXAMPLE XXI

A photoreceptive device was prepared by providing an aluminized Mylar substrate in a thickness of 3 mils, and applying thereto in a wet thickness of 0.5 mils, a layer of 0.5 percent by weight of duPont 49,000 adhesive, in methylene chloride and 1,1,2-trichloroethane (4:1 volume ratio) with a Bird applicator. This layer was allowed to dry for one minute at room temperature and 10 minutes at 100° C. in a forced air oven. The dry thickness of the resulting layer was 0.05 microns.

The above adhesive layer was then overcoated with a charge transport layer which was prepared as follows:

A transport layer containing 40 percent by weight Makrolon ®, a polycarbonate resin having a molecular weight ($M_w$) of from about 50,000 to about 100,000 available from Larbensabricken Bayer A.G., was mixed with 60 percent by weight NOPA. This solution was then mixed in 15 percent by weight of methylene chloride. All of these components were then placed into an amber bottle and dissolved. This mixture was coated to a dry 25 micron thickness layer over the adhesive layer with a Bird applicator. During this coating process the humidity was equal to or less than 15 percent. This device was then dried in a forced air oven for 6 minutes at 135° C.

A layer containing 30 percent by volume of vanadyl phthalocyanine was then prepared as follows:

In a 2 oz. amber bottle was added 0.76 grams of duPont 49,000 polyester in 16 milliliters methylene chloride. Added to this solution was 0.36 grams of vanadyl phthalocyanine, and 100 grams ⅛" stainless steel shot. The above mixture was placed on a ball mill for 24 hours. To 5 grams of this slurry was added 10 milliliters of methylene chloride. This slurry was coated over the above transport layer with a Bird applicator, to a wet thickness of 0.5 mils. This layer was allowed to air dry for 5 minutes. This device was dried at 135° C. for 6 minutes in a forced air oven. The dry thickness was 0.5 microns.

EXAMPLE XXII

A photoreceptive device was prepared by providing an aluminized Mylar substrate in a thickness of 3 mils, and applying thereto in a wet thickness of 0.5 mils, a layer of 0.5 percent by weight of duPont 49,000 polyester adhesive, in methylene chloride and 1,1,2-trichloroethane (4:1 volume ratio) with a Bird applicator. This layer was then allowed to dry for one minute at room temperature and 10 minutes at 100° C. in a forced air oven. The resulting layer had a dry thickness of about 0.05 microns.

The above adhesive layer was then overcoated with a charge transport layer which was prepared as follows:

A transport layer containing 40 percent by weight Makrolon ®, a polycarbonate resin having a molecular weight ($M_w$) of from about 50,000 to about 100,000 available from Larbensabricken Bayer A.G., was mixed with 60 percent by weight NOPA. This solution was then mixed in 15 percent by weight of methylene chloride. All of these components were then placed into an amber bottle and dissolved. The mixture was coated to a dry 25 micron thickness layer over the adhesive layer with a Bird applicator. During this coating process the humidity was equal to or less than 15 percent. The resulting device containing all of the above layers was annealed at 135° C. in a forced air oven for 6 minutes.

A layer containing 30 percent by volume of hydroxy squarylium was then prepared as follows:

In a 2 oz. amber bottle was added 0.76 grams Formvar 12/85, commercially available from Monsanto Chemical Company and 16 milliliters tetrahydrofuran. Added to this solution was 0.36 grams of hydroxy squarylium and 100 grams ⅛" stainless steel shot. The above mixture was placed on a ball mill for 24 hours. To 5 grams of this slurry was added 10 milliliters of tetrahydrofuran. This slurry formed was then coated over the above transport layer with a Bird applicator, to a wet thickness of 0.5 mils. The resulting layer was allowed to air dry for 5 minutes. This device was dried at 135° C. for 6 minutes in a forced air oven. The dry thickness of the photoconductive layer was 0.5 microns.

EXAMPLE XXIII

A photoreceptive device was prepared by providing an aluminized Mylar substrate in a thickness of 3 mils, and applying thereto in a wet thickness of 0.5 mils, a layer of 0.5 percent by weight of duPont 49,000 adhesive, in methylene chloride and 1,1,2-trichloroethane (4:1 volume ratio) with a Bird applicator. This layer was then allowed to dry for one minute at room temperature and 10 minutes at 100° C. in a forced air oven. The resulting layer had a dry thickness of about 0.05 microns.

The above adhesive layer was then overcoated with a charge transport layer which was prepared as follows:

A transport layer containing 40 percent by weight Makrolon ®, a polycarbonate resin having a molecular weight ($M_w$) of from about 50,000 to about 100,000 available from Larbensabricken Bayer A.G., was mixed with 60 percent by weight NOPA. This solution was then mixed in 15 percent by weight of methylene chloride. All of these components were then placed into an amber bottle and dissolved. The mixture was coated to a dry 25 micron thickness layer over the adhesive layer with a Bird applicator. During this coating process the humidity was equal to or less than 15 percent. This device then dried at 135° C. for 6 minutes in a forced air oven.

A layer containing 30 percent by volume vanadyl phthalocyanine was then prepared as follows:

In a 2 oz. amber bottle was added 0.76 grams of duPont 49,000 polyester in 16 milliliters methylene chloride. Added to this solution was 0.36 grams of vanadyl phthalocyanine, and 100 grams ⅛" stainless steel shot.

The above mixture was placed on a ball mill for 24 hours. To 5 grams of this slurry was added 10 milliliters of methylene chloride. This slurry was coated over the above transport layer with a Bird applicator, to a wet thickness of 0.5 mils. This layer was allowed to air dry for 5 minutes. This device was dried at 135° C. for 6 minutes in a forced air oven. The dry thickness was 0.5 microns.

The photogenerator layer with 10 percent volume trigonal selenium, 25 percent by volume of NOPA and 65 volume percent of polyvinyl carbazole was then prepared as follows:

In a 2 oz. amber bottle was added 0.8 grams polyvinyl carbazole and 14 milliliters, 1:1 volume ratio, tetrahydrofuran/toluene. Added to this solution was 0.8 grams of trigonal selenium and 100 grams of ⅛" stainless steel shot. The above mixture was then placed on a ball mill for 72 to 96 hours. 5 grams of this slurry was added to a solution of 0.18 grams of polyvinyl carbazole and 0.15 grams NOPA in 6.3 milliliters of tetrahydrofuran/toluene. This mixture was then placed on a shaker for 10 minutes. The slurry was then coated over the above photoconductive layer with a Bird applicator, to a wet thickness of 0.5 mils. This layer was dried at 135° C. for 6 minutes in a forced air oven. The dry thickness was 2.0 microns.

EXAMPLE XXIV

A photoreceptive device was prepared by providing an aluminized Mylar substrate in a thickness of 3 mils, and applying thereto in a wet thickness of 0.5 mils, a layer of 0.5 percent by weight of duPont 49,000 polyester adhesive, in methylene chloride and 1,1,2-trichloroethane (4:1 volume ratio) with a Bird applicator. The layer was allowed to dry for one minute at room temperature and 10 minutes at 100° C. in a forced air oven. The resulting layer had a dry thickness of about 0.05 microns.

The above adhesive layer was then overcoated with a charge transport layer which was prepared as follows:

A transport layer containing 40 percent by weight Makrolon ®, a polycarbonate resin having a molecular weight ($M_w$) of from about 50,000 to about 100,000 available from Larbensabricken Bayer A.G., was mixed with 60 percent by weight NOPA. This solution was then mixed in 15 percent by weight of methylene chloride. All of these components were then placed into an amber bottle and dissolved. The mixture was coated to a dry 25 micron thickness layer over the adhesive layer with a Bird applicator. During this coating process the humidity was equal to or less than 15 percent. This layer was dried at 135° C. for 6 minutes in a forced air oven.

A layer containing 30 percent by volume vanadyl phthalocyanine was then prepared as follows:

In a 2 oz. amber bottle was added 0.76 grams of duPont 49,000 polyester in 16 milliliters methylene chloride. Added to this solution was 0.36 grams of vanadyl phthalocyanine, and 100 grams of ⅛" stainless steel shot. The above mixture was placed on a ball mill for 24 hours. To 5 grams of this resulting slurry was added 10 milliliters of methylene chloride. This slurry was coated over the above transport layer with a Bird applicator, to a wet thickness of 0.5 mils. The layer was allowed to air dry for 5 minutes to a dry thickness of 0.5 microns. This device was dried at 135° C. for 6 minutes in a forced air oven.

A photogenerator layer containing 30 percent by volume of trigonal selenium and 25 percent by volume of NOPA was then prepared as follows:

In a 2 oz. amber bottle was added 0.8 grams polyvinyl carbazole and 18 milliliters, 1:1 volume ratio, tetrahydrofuran/toluene. Added to this solution was 2.1 grams of trigonal selenium and 100 grams of ⅛" stainless steel shot. The above mixture was then placed on a ball mill for 72 to 96 hours. In a 1 oz. amber bottle was added 0.04 grams NOPA, and 6.4 milliliters of tetrahydrofuran/toluene. Added to this solution was 2 grams of the ball milled slurry. The resulting mixture was then placed on a shaker for 10 minutes, and the slurry formed was then coated over the above photoconductive layer with a Bird applicator, to a wet thickness of 0.5 mils. This device was allowed to air dry for 5 minutes. The dry thickness of the resulting photogenerating generator layer was 0.5 microns. This layer was dried at 135° C. for 6 minutes.

EXAMPLE XXV

A photoreceptive device was prepared by providing an aluminized Mylar substrate in a thickness of 3 mils, and applying thereto in a wet thickness of 0.5 mils, a layer of 0.5 percent by weight of duPont 49,000 adhesive, in methylene chloride and 1,1,2-trichloroethane (4:1 volume ratio) with a Bird applicator. This layer was then allowed to dry for one minute at room temperature and 10 minutes at 100° C. in a forced air oven. The resulting layer had a dry thickness of about 0.05 microns.

The above adhesive layer was then overcoated with a charge transport layer which was prepared as follows:

A transport layer containing 40 percent by weight Makrolon ®, a polycarbonate resin having a molecular weight ($M_w$) of from about 50,000 to about 100,000 available from Larbensabricken Bayer A.G., was mixed with 60 percent by weight NOPA. This solution was then mixed in 15 percent by weight of methylene chloride. All of these components were placed into an amber bottle and dissolved. The mixture was coated to a dry 25 micron thickness layer over the adhesive layer with a Bird applicator at a humidity equal to or less than 15 percent. This device then dried at 135° C. for 6 minutes in a forced air oven.

A layer containing 30 percent by volume vanadyl phthalocyanine was then prepared as follows:

In a 2 oz. amber bottle was added 0.76 grams of duPont 49,000 polyester in 16 milliliters methylene chloride. Added to this solution was 0.36 grams of vanadyl phthalocyanine, and 100 grams of ⅛" stainless steel shot. The above mixture was placed on a ball mill for 24 hours. To 5 grams of this slurry was added 10 milliliters of methylene chloride. This slurry was coated over the above transport layer with a Bird applicator, to a wet thickness of 0.5 mils. The layer was allowed to air dry for 5 minutes. This device was dried at 135° C. for 6 minutes in a forced air oven to a dry thickness of 0.5 microns.

A photogenerator layer containing 33 percent by volume of trigonal selenium, and 13 percent by volume of NOPA dispersed in a phenoxy resinous binder, 54 percent by volume, was then prepared as follows:

In a 4 oz. amber bottle was added 1.6 grams of the phenoxy resin Bakelite, available from Union Carbide, 0.4 grams of NOPA, 21 milliliters of methyl ethyl ketone, and 7 milliliters of methoxy ethyl acetate. Added to this solution was 3.2 grams of trigonal selenium, and 200 grams ⅛" stainless steel shot. The above mixture was placed on a ball mill for 72 to 96 hours. The slurry formed was then coated over the above photoconductive layer with a Bird applicator, to wet thickness of 0.5 mil and the resulting layer was allowed to air dry for 5 minutes to a dry thickness of 0.5 microns. The layer was then dried at 135° C. for 6 minutes in a forced air oven.

EXAMPLE XXVI

A photoreceptive device was prepared by providing an aluminized Mylar substrate in a thickness of 3 mils, and applying thereto a layer of 0.5 percent by weight of duPont 49,000 adhesive, a polyester available from duPont, in methylene chloride and 1,1,2-trichloroethane (4:1 volume ratio) with a Bird applicator. The layer was allowed to dry for one minute at room temperature and 10 minutes at 100° C. in a forced air oven. The resulting layer had a dry thickness of about 0.05 microns.

The above adhesive layer was then overcoated with a charge transport layer which was prepared as follows:

A transport layer containing 40 percent by weight Makrolon ®, a polycarbonate resin having a molecular weight ($M_w$) of from about 50,000 to about 100,000 available from Larbensabricken Bayer A.G., was mixed with 60 percent by weight NOPA. The resulting solution was then mixed in 15 percent by weight of methylene chloride. All of these components were placed into an amber bottle and dissolved. The mixture was coated to a dry 25 micron thickness layer over the adhesive layer with a Bird applicator. During this coating process the humidity was equal to or less than 15 percent. This device was then dried at 135° C. for 6 minutes in a forced air oven.

A photoconductive layer containing 30 percent by volume hydroxy squarylium was then prepared as follows:

In a 2 oz. amber bottle was added 0.76 grams Formvar 12/85, commercially available from Monsanto Chemical Company and 16 milliliters tetrahydrofuran. Added to this solution was 0.36 grams of hydroxy squarylium and 100 grams ⅛" stainless steel shot. The above mixture was placed on a ball mill for 24 hours. To 5 grams of this slurry was added 10 milliliters of additional solvent. This slurry formed was then coated over the above transport layer with a Bird applicator, to a wet thickness of 0.5 mils. The resulting device was dried at 135° C. for 6 minutes in a forced air oven. The dry thickness of the photoconductive layer was 0.5 microns.

The photogenerator layer containing 10 percent volume trigonal selenium, 25 percent by volume of NOPA and 65 volume percent of polyvinyl carbazole was then prepared as follows:

In a 2 oz. amber bottle was added 0.8 grams polyvinyl carbazole and 14 milliliters, 1:1 volume ratio, tetrahydrofuran/toluene. There was then added to this solution 0.8 grams of trigonal selenium and 100 grams of ⅛" stainless steel shot. The above mixture was then placed on a ball mill for 72 to 96 hours. Subsequently, 5 grams of this slurry was added to a solution of 0.18 grams of polyvinyl carbazole and 0.15 grams NOPA in 6.3 milliliters of tetrahydrofuran/toluene, volume ratio 1:1. This slurry was then placed on a shaker for 10 minutes. The resulting slurry was then coated over the above photoconductive layer with a Bird applicator, to a wet thickness of 0.5 mils. This layer was then dried at 135° C. for 6 minutes in a forced air oven, resulting in a dry thickness was 2.0 microns.

EXAMPLE XXVII

A photoreceptive device was prepared by providing an aluminized Mylar substrate in a thickness of 3 mils, and applying thereto, in a wet thickness of 0.5 mils, a layer of 0.5 percent by weight of duPont 49,000 adhesive, a polyester available from duPont, in methylene chloride and 1,1,2-trichloroethane (4:1 volume ratio) with a Bird applicator. The layer was allowed to dry for one minute at room temperature and 10 minutes at 100° C. in a forced air oven. The resulting layer had a dry thickness of about 0.05 microns.

The above adhesive layer was then overcoated with a charge transport layer which was prepared as follows:

A transport layer containing 40 percent by weight Makrolon ®, a polycarbonate resin having a molecular weight ($M_w$) of from about 50,000 to about 100,000 available from Larbvensabricken Bayer A.G., was mixed with 60 percent by weight NOPA. The resulting solution was then mixed in 15 percent by weight of methylene chloride. All of these components were placed into an amber bottle and dissolved. The mixture was coated to a dry 25 micron thickness layer over the adhesive layer with a Bird applicator. During this coating process the humidity was equal to or less than 15 percent. This device was then dried at 135° C. for 6 minutes in a forced air oven.

A photoconductive layer containing 30 percent by volume of hydroxy squarylium was then prepared as follows:

In a 2 oz. amber bottle was added 0.76 grams Formvar 12/85, and 16 milliliters tetrahydrofuran. Added to this solution was 0.36 grams of hydroxy squarylium and 100 grams ⅛" stainless steel shot. The above mixture was placed on a ball mill for 24 hours. To 5 grams of this slurry was added 10 milliliters of additional solvent. This slurry formed was then coated over the above transport layer with a Bird applicator, to a wet thickness of 0.5 mils. The resulting device was dried at 135° C. for 6 minutes in a forced air oven. The dry thickness of the photoconductive layer was 0.5 microns.

The photogenerator layer containing 30 percent volume trigonal selenium, 25 percent by volume of NOPA and 45 volume percent of polyvinyl carbazole was then prepared as follows:

In a 2 oz. amber bottle was added 0.8 grams polyvinyl carbazole and 18 milliliters, 1:1 volume ratio, tetrahydrofuran/toluene. There was then added to this solution 2.1 grams of trigonal selenium and 100 grams of ⅛" stainless steel shot. The above mixture was then placed on a ball mill for 72 to 96 hours. In a 1 oz. amber bottle was added 0.04 grams NOPA and 6.4 milliliters of tetrahydrofuran/toluene, volume ratio 1:1. Added to this solution was 2 grams of the ball milled slurry. This slurry was then placed on a shaker for 10 minutes. The resulting slurry was then coated over the above photoconductive layer with a Bird applicator, to a wet thickness of 0.5 mils. This device was then allowed to air dry 1 to 5 minutes to a dry thickness for the photogenerator layer of 0.5 microns. The resulting device was then dried at 135° C. for 6 minutes in a forced air oven.

EXAMPLE XXVIII

A photoreceptive device was prepared by providing an aluminized Mylar substrate in a thickness of 3 mils, and applying thereto, in a wet thickness of 0.5 mils, a layer of 0.5 percent by weight of duPont 49,000 adhesive, a polyester available from duPont, in methylene chloride and 1,1,2-trichloroethane (4:1 volume ratio) with a Bird applicator. The layer was allowed to dry for one minute at room temperature and 10 minutes at 100° C. in a forced air oven. The resulting layer had a dry thickness of about 0.05 microns.

The above adhesive layer was then overcoated with a charge transport layer which was prepared as follows:

A transport layer containing 40 percent by weight Makrolon ®, a polycarbonate resin having a molecular weight ($M_w$) of from about 50,000 to about 100,000 available from Larbensabricken Bayer A.G., was mixed with 60 percent by weight NOPA. This solution was then mixed in 15 percent by weight of methylene chloride. All of these components were placed into an amber bottle and dissolved. The mixture was coated to a dry 25 micron thickness layer over the adhesive layer with a Bird applicator. During this coating process the humidity was equal to or less than 15 percent. This device was then dried at 135° C. for 6 minutes in a forced air oven.

A layer containing 30 percent by volume of hydroxy squarylium was then prepared as follows:

In a 2 oz. amber bottle was added 0.76 grams Monsanto Formvar 12/85, and 16 milliliters tetrahydrofuran. Added to this solution was 0.36 grams of hydroxy squarylium and 100 grams ⅛" stainless steel shot. The above mixture was placed on a ball mill for 24 hours. To 5 grams of this slurry was added 10 milliliters of additional solvent. This slurry formed was then coated over the above transport layer with a Bird applicator, to a wet thickness of 0.5 mils. The resulting device was dried at 135° C. for 6 minutes in a forced air oven. The dry thickness of the photoconductive layer was 0.5 microns.

A photogenerator layer containing 33 percent by volume of trigonal selenium, and 13 percent by volume of NOPA in the phenoxy binder Bakelite available from Union Carbide was then prepared as follows:

In a 4 oz. amber bottle was added 1.6 grams of the above phenoxy resin, 0.4 grams of NOPA, 21 milliliters of methyl ethyl ketone, and 7 milliliters of methoxy ethyl acetate. Added to this solution was 3.2 grams of trigonal selenium, and 200 grams ⅛" stainless steel shot. The above mixture was placed on a ball mill for 72 to 96 hours. This slurry was then coated over the above photoconductive layer with a Bird applicator, to wet thickness of 0.5 mil. This layer was allowed to air dry 2 to 5 minutes. The dry thickness was 0.5 microns. The layer was then dried at 135° C. in formed air for 6 minutes.

EXAMPLE XXIX

A photoreceptive device was prepared by providing an aluminized Mylar substrate in a thickness of 3 mils, and applying thereto, in a wet thickness of 0.5 mils, a layer of 0.5 percent by weight of duPont 49,000 polyester adhesive, in methylene chloride and 1,1,2-trichloroethane (4:1 volume ratio) with a Bird applicator. The layer was allowed to dry for one minute at room temperature and 10 minutes at 100° C. in a forced air oven. The resulting layer had a dry thickness of about 0.05 microns.

The above adhesive layer was then overcoated with a charge transport layer which was prepared as follows:

A transport layer containing 40 percent by weight Makrolon ®, a polycarbonate resin having a molecular weight ($M_w$) of from about 50,000 to about 100,000 available from Larbensabricken Bayer A.G., was mixed with 60 percent by weight NOPA. This solution was then mixed in 15 percent by weight of methylene chloride. All of these components were placed into an amber bottle and dissolved. The mixture was coated to a dry 25 micron thickness layer over the adhesive layer with a Bird applicator. During this coating process the humidity was equal to or less than 15 percent. This device was then dried at 135° C. for 6 minutes in a forced air oven.

A photogenerator layer containing 33 percent by volume of trigonal selenium and 13 percent by volume of NOPA in a phenoxy resinous binder 54 percent by volume, was then prepared as follows:

In a 4 oz. amber bottle was added 1.6 grams of the above phenoxy resin, 0.4 grams of NOPA, 21 milliliters of methyl ethyl ketone, and 7 milliliters of methoxy ethyl acetate. Added to this solution was 3.2 grams of trigonal selenium, and 200 grams ⅛" stainless steel shot. The above mixture was placed on a ball mill for 72 to 96 hours. The slurry was then coated over the above transport layer with a Bird applicator, to wet thickness of 0.5 mil. The resulting layer was allowed to air dry 2 to 5 minutes. The dry thickness of the photoconductive layer was 0.5 microns. The layer was then dried at 135° C. in forced air for 6 minutes.

A photoconductive layer containing 30 percent by volume of vanadyl phthalocyanine was then prepared as follows:

In a 2 oz. amber bottle was added 0.76 grams of duPont 49,000 and 16 milliliters methylene chloride. Added to this solution was 0.36 grams of vanadyl phthalocyanine, and 100 grams of ⅛" stainless steel shot. The above mixture was placed on a ball mill for 24 hours. To 5 grams of this slurry was added 10 milliliters of methylene chloride. This slurry was coated over the above photogenerating layer with a Bird applicator, to a wet thickness of 0.5 mils. The layer was allowed to air dry for 5 minutes. The resulting device was dried at 135° C. for 6 minutes in a forced air oven. The dry thickness of the photoconductive layer was 0.5 microns.

EXAMPLE XXX

A photoreceptive device was prepared by providing an aluminized Mylar substrate in a thickness of 3 mils, and applying thereto, in a wet thickness of 0.5 mils, a layer of 0.5 percent by weight of duPont 49,000 adhesive, a polyester available from duPont, in methylene chloride and 1,1,2-trichloroethane (4:1 volume ratio) with a Bird applicator. The layer was allowed to dry for one minute at room temperature and 10 minutes at 100° C. in a forced air oven. The resulting layer had a dry thickness of about 0.05 microns.

The above adhesive layer was then overcoated with a charge transport layer which was then prepared as follows:

A transport layer containing 40 percent by weight Makrolon ®, a polycarbonate resin having a molecular weight ($M_w$) of from about 50,000 to about 100,000 available from Larbensabricken Bayer A.G., was mixed with 60 percent by weight NOPA. This solution was then mixed in 15 percent by weight of methylene chloride. All of these components were placed into an amber bottle and dissolved. The mixture was coated to a dry 25 micron thickness layer over the adhesive layer with a Bird applicator. During this coating process the humidity was equal to or less than 15 percent. This device was then dried in a forced air oven at 135° C. for 6 minutes.

A photogenerator layer containing 10 percent by volume of trigonal selenium, and 25 percent by volume of NOPA and 65 volume percent of polyvinyl carbazole was prepared as follows:

In a 2 oz. amber bottle was added 0.8 grams polyvinyl carbazole and 14 milliliters, 1:1 volume ratio, tetrahydrofuran/toluene. There was then added to this solution 0.8 grams of trigonal selenium and 100 grams of ⅛" stainless steel shot. The above mixture was then placed on a ball mill for 72 to 96 hours. In a 1 oz. amber bottle was added 0.15 grams NOPA, 0.18 grams polyvinylcarbazole, and 6.3 milliliters of tetrahydrofuran/toluene, volume ratio 1:1. Added to this solution was 5 grams of the ball milled slurry. The slurry formed was then placed on a shaker for 10 minutes. The resulting slurry was then coated over the above transport layer with a Bird applicator, to a wet thickness of 0.5 mils. This layer was then dried at 135° C. for 6 minutes in a forced air oven, resulting in a dry thickness for the generator layer of 2.0 microns.

The resulting device containing all of the above layer was annealed at 135° C. in a forced air oven for 6 minutes.

A photoconductive layer containing 30 percent by volume of hydroxy squarylium was then prepared as follows:

In a 2 oz. amber bottle was added 0.76 grams Monsanto Formvar 12/85, and 16 milliliters tetrahydrofuran. Added to this solution was 0.36 grams of hydroxy squarylium and 100 grams ⅛" stainless steel shot. The above mixture was placed on a ball mill for 24 hours. To 5 grams of this slurry was added 10 milliliters of additional solvent. This slurry was then coated over the above generator layer with a Bird applicator, to a wet thickness of 0.5 mils. The resulting device was dried at 135° C. for 6 minutes in a forced air oven. The dry thickness of the photoconductive layer was 0.5 microns.

EXAMPLE XXXI

A photoreceptive device was prepared by providing an aluminized Mylar substrate in a thickness of 3 mils, and applying thereto, in a wet thickness of 0.5 mils, a layer of 0.5 percent by weight of duPont 49,000 adhesive, a polyester available from duPont, in methylene chloride and 1,1,2-trichloroethane (4:1 volume ratio) with a Bird applicator. The layer was allowed to dry for one minute at room temperature and 10 minutes at 100° C. in a forced air oven. The resulting layer had a dry thickness of about 0.05 microns.

The above adhesive layer was then overcoated with a charge transport layer which was then prepared as follows:

A transport layer containing 40 percent by weight Makrolon ®, a polycarbonate resin having a molecular weight ($M_w$) of from about 50,000 to about 100,000 available from Larbensabricken Bayer A.G., was mixed with 60 percent by weight NOPA. This solution was then mixed in 15 percent by weight of methylene chloride. All of these components were placed into an amber bottle and dissolved. The mixture was coated to a dry 25 micron thickness layer over the adhesive layer with a Bird applicator. During this coating process the humidity was equal to or less than 15 percent. This device was then dried in a forced air oven at 135° C. for 6 minutes.

A photogenerating layer containing 33 percent by volume of trigonal selenium, and 13 percent by volume of NOPA in a Bakelite phenoxy binder was prepared as follows:

In a 4 oz. amber bottle was added 1.6 grams of the above phenoxy resin, 0.4 grams of NOPA, 21 milliliters of methyl ethyl ketone, and 7 milliliters of methoxy ethyl acetate. Added to this solution was 3.2 grams of trigonal selenium, and 200 grams ⅛" stainless steel shot. The above mixture was placed on a ball mill for 72 to 96 hours. The resulting slurry was then coated over the above transport layer with a Bird applicator, to wet thickness of 0.5 mil. The resulting layer was allowed to air dry 2 to 5 minutes, followed by drying at 135° C. in forced air for 6 minutes. The dry thickness of the photoconductive layer was 0.5 microns.

A photoconductive layer containing 30 percent by volume of hydroxy squarylium was then prepared as follows:

In a 2 oz. amber bottle was added 0.76 grams Monsanto Formvar 12/85, and 16 milliliters tetrahydrofuran. Added to this solution was 0.36 grams of hydroxy squarylium and 100 grams ⅛" stainless steel shot. The above mixture was placed on a ball mill for 24 hours. To 5 grams of this slurry was added 10 milliliters of additional solvent. This slurry was then coated over the above photogenerating layer with a Bird applicator, to a wet thickness of 0.5 mils. The resulting device was dried at 135° C. for 6 minutes in a forced air oven. The dry thickness of the photoconductive layer was 0.5 microns.

Each of the devices of Examples XVIII to XXXI were also overcoated with a top overcoating layer with a 1 percent solution of polyvinylbutyral in ethanol with a Bird applicator, to a wet thickness of 2 mils. The coating was then dried for 10 minutes and forced air dried at 50° C. for 2 hours resulting in a thickness of 0.5 microns for each top overcoating layer.

Each of the above prepared devices were then tested for photosensitivity in the visible and infrared region of the spectrum by positively charging the devices XVIII to XXXI with corona to a +800 volts, and negatively charging devices I to XVII with a corona to −800 volts followed simultaneously exposing each device to monochromatic light in a wavelength range of from about 400 to about 1,000 nanometers. The surface potential of each device was then measured with an electrical probe after exposure to given wavelengths. The percent discharge of each device was then calculated as disclosed hereinbefore, which percent discharge indicates photoresponse.

The photoresponse devices of Examples I, II, III, XVIII, XIX, and XX responded to light only in the wavelength of about 400 to 675 nanometers, indicating visible photosensitivity, while the photoresponsive devices of Examples IV, V, XXI, XXII responded to light in the wavelength of about 580 to 950 nanometers, with poor response in the blue and green wavelength range of the spectrum.

The devices as prepared in Examples VI to XVII, and XXIII to XXXI had excellent response in the wavelength range of from about 400 to about 950 nanometers, indicating both visible and infrared photosensitivity for these devices.

With further regard to the preparation of the aromatic ethers, there can be reacted as disclosed herein various halogen compounds, such as diidodiphenyl ethers with the appropriate aromatic amines, including N-phenyl-2-naphthylamine in the presence of a copper containing catalyst. Other halide ethers can be selected inclusive of the dichloro and dibromo diphenyl ethers, while examples of other amine reactants are N-arylnaphthylamines generally such as N-phenyl-1-naphthylamine, N-methyldiphenylamine and other appropriate reactants. Specifically, the amine identified herein as NOPA, namely bis-N-(2-naphthyl)-diphenylamine ether, was prepared as follows. This preparation sequence is applicable to the other ethers disclosed herein with the exception that the appropriate reactants are substituted for those specified.

EXAMPLE XXXII

There was prepared bis-N-(2-naphthyl)-diphenyl amine ether by placing into a 500 milliliter three neck flask, equipped with an agitator, a thermometer, a reflux condenser, a gas inlet, and a gas outlet, and a heating mantle, 21.1 grams of 4,4'-diiododiphenyl ether, 0.05 mols, 43.8 grams of N-phenyl-2-naphthylamine, 0.2 mols, 27.6 grams of anhydrous potassium carbonate, 0.2 mols, 30.0 grams of copper powder, and 100 milliliters of sulfolane. Thereafter, the reaction flask was purged free of air with argon gas, followed by heating this mixture under an argon atmosphere at 215° to 220° C. for 16 hours. During heating, the reaction mixture was stirred with a mechanical agitator. Thereafter the mixture was cooled to 100° C. and 300 milliliters of toluene was added thereto. The inorganic salts formed and copper were then removed from the reaction mixture by filtration through a sintered glass funnel. There remained a filtrate containing the product and the solvents sulfolane and toluene. The toluene was removed by stripping in a rotary evaporator. There was then mixed with the remaining residue 300 milliliters of water and the precipitated resulting oily product was separated by decantation. This oily product was then dissolved in octane, followed by purification by directing the resulting solution through a column filled with alumina, and periodically removing fractions therefrom. The fraction which yielded a practically white powder, after solvent stripping, was collected. The compound product, 11.48 grams, melting point 143° to 148° C. was identified as bis-N-(2-naphthyl)-diphenylamine ether, by infrared spectroscopy, and mass spectrometry. Thin layer chromatography indicated one fluorescent main component under U.V. illumination (366 nanometer wavelength).

Although the invention has been described with reference to specific preferred embodiments, it is not intended to be limited thereto, rather those skilled in the art will recognize variations and modifications may be made therein which are within the spirit of the invention and within the scope of the following claims.

What is claimed is:

1. An improved photoresponsive device comprised of a substrate, a photogenerating layer, and a hole transport layer, containing a transporting composition of the formula R—X—$R_1$, excluding azomethine moieties, and wherein R and $R_1$ are independently selected from arylamino and substituted arylamino groups, and X is selected from the group consisting of oxygen, sulfur, selenium, and tellurium dispersed in an inactive resinous binder.

2. An improved photoresponsive device in accordance with claim 1 wherein the photogenerating layer is comprised of inorganic photoconductive pigments, or organic photoconductive pigments, optionally dispersed in resinous binder materials.

3. An improved photoresponsive device in accordance with claim 1 wherein the photogenerating pigment is vanadyl phthalocyanine or trigonal selenium.

4. An improved photoresponsive device in accordance with claim 2 wherein the resinous binder is polyvinyl carbazole, or a polyhydroxy ether.

5. An improved photoresponsive device in accordance with claim 1 wherein the photogenerating pigment is dispersed in the inactive resinous binder in an amount of from about 10 volume percent to about 90 volume percent.

6. An improved photoresponsive device in accordance with claim 1 wherein the inactive resin binder is a polycarbonate.

7. An improved photoresponsive device in accordance with claim 1 wherein the substrate is insulating.

8. An improved photoresponsive device in accordance with claim 1 wherein the hole transporting composition is bis-triphenylamine ether.

9. An improved photoresponsive device in accordance with claim 1 wherein the hole transporting composition is bis-N-(2-naphthyl)-diphenylamine ether.

10. An improved photoresponsive device in accordance with claim 1 wherein the transport molecule is [N-diphenyl]-naphthylamine ether.

11. An improved photoresponsive device in accordance with claim 1 wherein the hole transport layer is situated between the substrate and the photogenerating layer.

12. An improved photoresponsive device in accordance with claim 1 wherein the photogenerating layer is situated between the supporting substrate and the hole transport layer.

13. An improved photoresponsive device comprised of a substrate, a photogenerating layer, a photoconductive layer, and a hole transport layer containing the hole transporting composition of claim 1 dispersed in inactive resinous binder.

14. An improved photoresponsive device in accordance with claim 13 wherein the photoconductive layer is situated between the photogenerating layer and the hole transport layer.

15. An improved photoresponsive device in accordance with claim 13 wherein the photoconductive layer is situated between the substrate and the photogenerating layer.

16. An improved photoresponsive device in accordance with claim 13 wherein the hole transport composition is bis-triphenylamino ether.

17. An improved photoresponsive device in accordance with claim 13 wherein the hole transport composition is bis-N-(2-naphthyl)-diphenylamine ether.

18. An improved photoresponsive device in accordance with claim 13 wherein the hole transport composition is bis-N-(1-naphthyl)-diphenylamine ether.

19. An improved photoresponsive device in accordance with claim 13 wherein the hole transport composition is bis-N-(methyl)diphenylamine ether.

20. An improved photoresponsive device in accordance with claim 13 wherein the hole transport composition is bis-N-(alkyl)diphenylamine ether.

21. An improved photoresponsive device in accordance with claim 14 wherein the hole transport composition is bis-triphenylamino ether.

22. An improved photoresponsive device in accordance with claim 14 wherein the hole transport composition is bis-N-(2-naphthyl)-diphenylamine ether.

23. An improved photoresponsive device in accordance with claim 14 wherein the hole transport composition is bis-N-(1-naphthyl)-diphenylamine ether.

24. An improved photoresponsive device in accordance with claim 14 wherein the hole transport composition is bis-N-(methyl)diphenylamine ether.

25. An improved photoresponsive device in accordance with claim 14 wherein the hole transport composition is bis-N-(alkyl)diphenylamine ether.

26. An improved photoresponsive device in accordance with claim 1 wherein the aryl groups contain from 6 carbon atoms to about 24 carbon atoms.

27. An improved photoresponsive device in accordance with claim 1 wherein the aryl groups are substituted with alkyl substituents.

28. An improved photoresponsive device in accordance with claim 1 wherein the aryl groups are phenyl or naphthyl.

29. An improved photoresponsive device in accordance with claim 1 wherein R and $R_1$ are phenyl.

30. An improved photoresponsive device in accordance with claim 1 wherein R and $R_1$ are naphthyl.

31. An improved photoresponsive device consisting essentially of a substrate, photogenerating layer, and a hole transport layer, containing a transporting composition of the formula R—X—$R_1$, excluding azomethine moieties, and wherein R and $R_1$ are independently selected from arylamino and substituted arylamino groups, and X is selected from the group consisting of oxygen, sulfur, selenium, and tellurium dispersed in an inactive resinous binder.

32. A photoresponsive imaging member in accordance with claim 1 wherein the hole transporting composition is present in an amount of from about 10 percent by weight to about 95 percent by weight based on the weight of the resinous binder.

33. A photoresponsive imaging member in accordance with claim 1 wherein the hole transporting composition is present in an amount of from about 40 percent by weight to about 70 percent by weight based on the weight of the resinous binder.

34. An improved photoresponsive device consisting of a substrate, a photogenerating layer, and a hole transport layer, containing a transporting composition of the formula R—X—$R_1$, excluding azomethine moieties, and wherein R and $R_1$ are independently selected from arylamino and substituted arylamino groups, and X is selected from the group consisting of oxygen, sulfur, selenium, and tellurium dispersed in an inactive resinous binder.

35. A photoresponsive imaging member in accordance with claim 34 wherein the hole transporting composition is present in an amount of from about 10 percent by weight to about 95 percent by weight based on the weight of the resinous binder.

* * * * *